US010724369B2

(12) United States Patent
Torres Delgado et al.

(10) Patent No.: US 10,724,369 B2
(45) Date of Patent: Jul. 28, 2020

(54) MINERAL WINNING PICK, PICK HOLDER, AND COMBINATION

(71) Applicant: ESCO Corporation, Portland, OR (US)

(72) Inventors: Roberto de Jesus Torres Delgado, Scappoose, OR (US); William Stephen Clapham, Barnsley (GB)

(73) Assignee: ESCO GROUP LLC, Portland, OR (US)

( * ) Notice: Subject to any disclaimer, the term of this patent is extended or adjusted under 35 U.S.C. 154(b) by 737 days.

(21) Appl. No.: 14/308,528

(22) Filed: Jun. 18, 2014

(65) Prior Publication Data

US 2014/0368022 A1 Dec. 18, 2014

Related U.S. Application Data

(60) Provisional application No. 61/836,271, filed on Jun. 18, 2013.

(51) Int. Cl.

| | |
|---|---|
| ***E21C 35/18*** | (2006.01) |
| ***E21C 35/19*** | (2006.01) |
| ***E21C 35/187*** | (2006.01) |
| ***E21C 35/183*** | (2006.01) |
| *E21C 35/193* | (2006.01) |

(52) U.S. Cl.

CPC ..... *E21C 35/18* (2013.01); *E21C 35/183* (2013.01); *E21C 35/187* (2013.01); *E21C 35/19* (2013.01); *E21C 35/1936* (2013.01)

(58) Field of Classification Search

CPC ..... E21C 35/19; E21C 35/18; E21C 35/193; E21C 35/1936; E21C 2035/182

See application file for complete search history.

(56) References Cited

U.S. PATENT DOCUMENTS

| | | | | |
|---|---|---|---|---|
| 2,601,978 A | | 7/1952 | Simmons | |
| 2,747,852 A | | 5/1956 | Krekeler | |
| 2,838,295 A | | 6/1958 | Compton | |
| 3,030,088 A | * | 4/1962 | Devine | E21C 35/1936 267/175 |
| 3,073,582 A | | 1/1963 | Delli-Gatti, Jr. | |
| 3,223,452 A | * | 12/1965 | Krekeler | E21C 35/19 299/109 |
| 3,246,930 A | * | 4/1966 | Krekeler | E21C 35/19 279/79 |
| 3,305,274 A | | 2/1967 | Goodfellow, Jr. et al. | |

(Continued)

FOREIGN PATENT DOCUMENTS

| | | |
|---|---|---|
| EP | 220335 | 5/1987 |
| EP | 300987 | 1/1989 |

(Continued)

*Primary Examiner* — David J Bagnell
*Assistant Examiner* — Michael A Goodwin
(74) *Attorney, Agent, or Firm* — Palmer Dzurella

(57) ABSTRACT

An improved pick and pick holder assembly for use in mineral winning and the like. The improved pick and pick holder increases the effective life of a tool and pick holder by minimizing the shifting of the pick within the pick holder. The movement of the pick is minimized by front and rear bearing surfaces that remain positively engaged with front and rear bearing surfaces of the pick holder for loads applied to the pick that are predominantly inward and predominantly rearward.

48 Claims, 20 Drawing Sheets

(56) References Cited

U.S. PATENT DOCUMENTS

| | | | | | |
|---|---|---|---|---|---|
| 3,343,883 | A * | 9/1967 | Whittaker | E21C 35/18 | 299/53 |
| 3,512,838 | A | 5/1970 | Kniff | | |
| 3,575,467 | A * | 4/1971 | Davis | E21C 35/19 | 299/109 |
| 3,589,452 | A | 6/1971 | Haker et al. | | |
| 3,751,114 | A * | 8/1973 | Davis | E21C 35/183 | 299/85.2 |
| 3,820,849 | A * | 6/1974 | Lundstrom et al. | E21C 35/19 | 299/108 |
| 4,057,294 | A | 11/1977 | Krekeler | | |
| 4,068,897 | A * | 1/1978 | Amoroso | E21C 35/18 | 175/413 |
| 4,261,619 | A * | 4/1981 | Howe | B02C 18/18 | 299/109 |
| 4,302,055 | A * | 11/1981 | Persson | B28D 1/188 | 279/86 |
| 4,346,934 | A * | 8/1982 | College | E21C 35/197 | 175/354 |
| 4,456,307 | A | 6/1984 | Merten et al. | | |
| 4,557,525 | A | 12/1985 | Marten et al. | | |
| 4,609,227 | A * | 9/1986 | Wild | E21C 35/18 | 299/103 |
| 4,652,056 | A * | 3/1987 | Parrott | E21C 35/187 | 299/17 |
| 4,762,372 | A | 8/1988 | Rassmann et al. | | |
| 4,776,639 | A | 10/1988 | Braun et al. | | |
| 4,819,990 | A | 4/1989 | Breuer et al. | | |
| 4,880,247 | A * | 11/1989 | Herridge | E21C 35/19 | 279/79 |
| 4,913,125 | A * | 4/1990 | Bunting | E21C 35/19 | 125/40 |
| 4,998,778 | A | 3/1991 | Braun et al. | | |
| 5,007,684 | A | 4/1991 | Parrott | | |
| 5,195,805 | A | 3/1993 | Clapham | | |
| 5,234,258 | A | 8/1993 | Komatzki | | |
| 5,322,351 | A | 6/1994 | Lent | | |
| 5,378,050 | A * | 1/1995 | Kammerer | E21C 35/193 | 299/102 |
| 5,573,308 | A * | 11/1996 | Simons | E21C 35/19 | 299/102 |
| 5,799,741 | A * | 9/1998 | Kosobrodov | E21B 10/006 | 175/350 |
| 5,992,405 | A | 11/1999 | Sollami | | |
| 6,099,081 | A | 8/2000 | Clapham | | |
| 6,186,597 | B1 * | 2/2001 | Hahn | E21C 35/18 | 299/102 |
| 6,234,579 | B1 | 5/2001 | Montgomery, Jr. | | |
| 6,257,672 | B1 | 7/2001 | Parrott | | |
| 6,764,141 | B2 | 7/2004 | O'Neill | | |
| 7,073,870 | B2 | 7/2006 | Tillessen et al. | | |
| 7,300,115 | B2 | 11/2007 | Holl et al. | | |
| 7,310,897 | B2 | 12/2007 | Tillessen et al. | | |
| 7,320,505 | B1 | 1/2008 | Hall et al. | | |
| 7,338,135 | B1 | 3/2008 | Hall et al. | | |
| D567,270 | S | 4/2008 | Chiang | | |
| 7,393,061 | B2 | 7/2008 | Hasse et al. | | |
| D575,610 | S | 8/2008 | Holl et al. | | |
| 7,461,903 | B2 | 12/2008 | Tewes et al. | | |
| 7,784,875 | B2 | 8/2010 | Holl et al. | | |
| D671,578 | S | 11/2012 | Buhr et al. | | |
| 8,322,795 | B2 | 12/2012 | Zimmerman et al. | | |
| 8,622,484 | B2 | 1/2014 | Charlton | | |
| 9,151,157 | B2 | 10/2015 | Lehnert et al. | | |
| 9,206,686 | B2 | 12/2015 | Ball et al. | | |
| 2005/0082898 | A1 | 4/2005 | Keller | | |
| 2008/0093912 | A1 * | 4/2008 | Willoughby | E21C 35/19 | 299/107 |
| 2009/0289493 | A1 * | 11/2009 | Holl | E21C 35/18 | 299/102 |
| 2010/0194176 | A1 | 8/2010 | Lucek et al. | | |
| 2012/0274123 | A1 | 11/2012 | Ball | | |
| 2013/0076102 | A1 | 3/2013 | Pizzato et al. | | |
| 2013/0241266 | A1 * | 9/2013 | Lehnert | E21C 35/18 | 299/81.1 |
| 2014/0015305 | A1 * | 1/2014 | Jonker | E02F 3/20 | 299/105 |

FOREIGN PATENT DOCUMENTS

| | | |
|---|---|---|
| GB | 1348488 | 3/1974 |
| GB | 2035419 | 6/1980 |
| GB | 2071184 | 9/1981 |
| GB | 2182373 | 5/1987 |
| GB | 2207691 | 2/1989 |
| GB | 2249116 | 4/1992 |
| GB | 2299354 | 10/1996 |
| RU | 2039869 | 7/1995 |
| RU | 2071562 | 1/1997 |
| RU | 2347907 | 2/2009 |
| SU | 810960 | 3/1981 |
| WO | WO 2013/021283 | 2/2013 |

* cited by examiner

MINERAL WINNING PICK, PICK HOLDER, AND COMBINATION

RELATED APPLICATION

This application claims priority benefits to U.S. Provisional Patent Application No. 61/836,271 filed Jun. 18, 2013 and entitled "Mineral Winning Pick, Tool Holder, and Combination," which is incorporated herein by reference in its entirety.

FIELD OF THE INVENTION

The present invention pertains to a pick and pick holder, primarily for use in mineral winning, such as coal mining, but also useable for other underground purposes such as tunnel or roadway driving, or above ground for civil engineering works, such as road planning, trench cutting, both on land and sub-sea.

BACKGROUND OF THE INVENTION

In coal and other kinds of mining by the Longwell technique, it is conventional for minerals to be removed by a single or double ended ranging shearer drum, which traverses the mineral face with a rotary cutting head carried by the, or each, ranging arm to follow the seam. Typically, each drum is provided with 50 or more locations where a cutting tool is required. A pick holder is welded in place at each location. Each pick holder supports a replaceable pick designed to engage the ground. In some constructions, each pick holder also contains a water sprayer to the rear of the pick for spraying the working end (i.e., the head) of the pick and the coal with water. In general, each pick comprises a pick shank, a securement mechanism to maintain the pick in the pick holder, a head, and a transition area between the head and the shank. The transition area often consists of a rear heel and a forward toe or shoulder.

In use, the shearer drum is rotated about its central axis. As the drum rotates the pick holders spin around with the drum so that picks engage the ground. The water sprayer within the pick holder sprays water on the pick and the coal to minimize dust and the risk of frictional ignitions.

When the pick contacts the wall while the shearer drum rotates, the picks experience forces F as the pick breaks up the material to be excavated. The force F will at times be normal N to the tip 24 with respect to the material face such as along a line 1*a* normal and orthogonal to the frontal direction. Line 1*a* goes through the forward most impact point of the pick 10*a* to the center of rotation of the pick assembly 8*a* around the excavating equipment 4. In this application, a force that is along line 1*a* and only has a normal component N is referred to as a normal (or inward) force and a force F that is collinear or tangent T to the cutting path (i.e., orthogonal to line 1*a* and only has a tangential component) is referred to as a tangential (or rearward) force.

As a pick rotates around with the drum 6, the pick will experience a force F that will at times be primarily tangential (i.e., a force that extends perpendicular to a force that extends normally through the strike point of the tip to the center of rotation of the pick assembly around the drum and has an angle $\alpha$ of 0 degrees). Other times the pick will experience a force at an angle $\alpha$ from tangential T that has a tangential component and a normal component (i.e., a force between tangential T and normal N). As the pick continues to rotate the pick will experience a force that is primarily normal (i.e., a force that is primarily inward on the pick and has an angle $\alpha$ of 90 degrees from tangential T and that extends normally through the strike point of the tip 24*a* to the center of rotation of the pick assembly around the drum 6). The transition of forces between those that are predominantly inward or normal and those that are predominantly rearward or tangential causes the pick to rock within the pick holder. The cyclic rocking causes the pick to wear the pick holder prematurely as can be seen in FIG. 4. Premature wear on the pick holder causes the pick locking system to become ineffective and leads to picks being ejected from the pick holder during use. Typically, when a pick breaks or is ejected the pick will also break the water sprayer.

Damaged holders must be cut from the drum and new holders welded in their place. Because of the risk of frictional ignitions and tight dark working areas, typically, shearer drums must be removed from the longwall (i.e., removed from service) and moved to a safe location for refurbishment, for example to the surface. Moving the shearer drum, cutting the welds between the shearer drums and the pick holder, and welding new pick holders in place is time consuming. Such refurbishment can be lengthy and expensive.

SUMMARY OF THE INVENTION

The present invention pertains to an improved pick and pick holder assembly for use in mineral winning and the like. With the present construction, the effective life of a pick and pick holder is extended. Extending the effective life of the pick and pick holder translates to less downtime encountered and greater productivity.

In accordance with one aspect of the invention, the pick has a shank with bearing surfaces that remain positively engaged with bearing surfaces of the pick holder for loads applied to the pick that are predominantly inward and predominantly rearward. With this construction, the pick and pick holder are better able to resist shifting of the pick when the loads shift between rearward and inward loads during operation of a supporting drum or cutting chain. Reduced shifting results in reduced wearing of the components and, in particular, the walls of the opening in the pick holder. The reduced shifting may also increase the ability of the blade (i.e., the cutting portion of the head containing a leading edge of the pick) and the carbide tip (embedded in the blade) to better withstand the wash of material flow as the pick engages the ground (i.e., the leading edge of the pick may experience less wear and thus may better be able to retain the carbide tip within the pick). Reducing wear of the parts, and especially the pick and pick holder, reduces downtime of the machine and increases productivity.

In another aspect of the invention, the pick has a head to engage the ground and a shank to fit into an opening in the holder. The head and the shank are aligned in a plane coincident with each other and the shank is rearwardly inclined relative to inwardly directed forces applied to the pick, such that the shank abuts the front and rear walls of the pick holder across transitions between inward and rearward forces applied to the pick head.

In another aspect of the invention, the pick has a head with a tip to make contact with the ground, and a shank received within the opening of the holder. The shank is rearwardly inclined relative to inward forces on the tip (e.g., the shank is oriented such that a line running along a true inwardly-directed load applied to the distal end will intersect the shank) and complementary to the opening in the holder such that the front and rear bearing surfaces of the shank and holder tend to bear against one another regardless of whether the loads are predominantly inward or rearward. The rearward inclination helps to distribute the forces between the bearing surfaces of the shank to reduce wear of the components, and especially the pick holder.

In accordance with the invention, the pick engages the ground and experiences forces causing the pick to exert reactionary forces on the pick holder. The rearward inclination of the shank adds stability by giving the pick a natural tendency to abut the front and rear walls of a hole within the pick holder even when the pick experiences forces that at times are generally inward (i.e., having a predominantly normal force component), generally rearward (i.e., having a predominantly tangential force component), or a force between tangential and normal (i.e., a force with a normal component and a tangential component).

In another aspect of the invention, the shank of the pick and the opening of the pick holder include complementary securing structures, such as a C-shaped hook and recess, to more positively couple the parts together to reduce the risks of ejection during use.

In another aspect of the invention, the front and rear of the shank are defined by diverging surfaces that complement and mirror front and rear bearing surfaces on the pick holder. The front and rear bearing surfaces on the pick and pick holder increase the bearing surfaces of the pick against the pick holder. The use of diverging bearing surfaces along the front and rear portions of the pick shank and pick holder opening adds stability to better counter transitions between rearward and side forces during use; i.e., the diverging (or laterally inclined) bearing surfaces are able to resist both rearward and side loads to lessen shifting of the pick as the loads change during use and thereby lessen wearing of the components.

In another aspect of the invention, the pick includes a head and a shank. The front surface of the shank is provided with laterally inclined (i.e., rearwardly diverging) surfaces at the juncture of the head and the shank (i.e., extending downward along the shank from the bottom of the head), which are designed to withstand ordinary loads but when subjected to extreme loading (such as when striking a metal brace in the mine wall) cause the pick to break along the juncture of the head and shank. In this way, when the pick breaks due to a fracture force the pick shoulder is broken off of the shoulder and the pick shank can be easily removed by pushing it downward (i.e., inward) through the holder and out of a notch in the drum.

In accordance with another aspect of the invention, the bottom of the pick head and the pick holder include diverging (or laterally inclined) surfaces. The widest portions of the diverging surfaces of the pick are preferably constrained to have a width that is generally less than or equal to the width of the shank. The diverging surfaces of the pick holder and the pick are offset from the top surface of the pick holder so that the diverging surfaces bear against an internal surface of the pick holder. The diverging surfaces maximizes the surface area between the pick and the pick holder and thus increases the bearing area between the components. In addition, the diverging surfaces provide stability from side forces, reduces the surface pressure the pick exerts on the pick holder, and reduces shifting of the pick in the holder as the load direction changes during use.

In accordance with another aspect of the invention, the pick is provided with a shoulder and a blade. The shoulder extends below the blade and protrudes forward of the blade (i.e., the underside bearing surface of the shoulder extends forward of a line running along a true inwardly-directed load applied to the distal end of the carbide tip of the head of the pick). In the example of a pick on a drum, the underside bearing surface extends forward of a line extending normally through the strike point of the tip to the center of rotation of the pick assembly around the drum. Having the shoulder extend forward of the blade increases the stability of the pick as the pick encounters inwardly directed forces.

In accordance with another aspect of the invention, the pick is provided with a shank and a head having a shoulder and a blade. The shoulder extends below the blade and protrudes forward of the blade. The shank is rearwardly inclined relative to the forces that are inward. The shoulder is generally perpendicular to a rear bearing surface of the shank. Having a rearwardly inclined bearing surface and a shoulder that is forward of the blade and generally perpendicular to the rear bearing surface of the shank allows both the rear bearing surface and the shoulder to withstand the inward forces applied to the pick.

In accordance with another aspect of the invention, the pick holder is lined with hard-facing material. The pick holder may be lined with hard-facing where the pick exerts reactionary forces on the pick holder, where the pick holder experiences wash, where the pick lock is maintained in the pick holder, and other locations on the pick holder that experience wear.

In another aspect of the invention, the pick is free of a heel to the rear of the shank enabling the front and rear walls of the hole to better bear the reactionary forces when the force has a predominantly tangential force component and when the force has a predominantly normal force component. A pick free of a heel also enables the front and rear walls of the hole to minimize undesired motion, and minimize the contact pressure between the pick and the pick holder. A pick free of a rear heel minimizes the redundant reaction points when the pick experiences inward loading (e.g., a force having a predominantly normal force component) and rearward (e.g., a force having a predominantly tangential force component) loading. A pick free of a rear heel also may eliminate any connection between the pick and the water sprayer reducing the likelihood of premature water sprayer breakage.

In another aspect of the invention, the pick shank has clearances on the front and rear surfaces so that the shank only has close tolerance with the hole of the pick holder where the intended reactionary forces are exerted thus allowing the shank to be removed with less force.

In another aspect of the invention, the pick holder receives a low profile water sprayer for spraying the working end of the pick (i.e., the head of the pick) and the coal with water thus allowing the water sprayer to be protected in normal operation as well as when a pick head becomes broken and ejects rearward.

In another aspect of the invention, one or more sides of blade may be provided with a recess designed to be engaged by a pry tool to pry the pick from the pick holder. The recess if preferably generally rectangular.

To gain an improved understanding of the advantages and features of the invention, reference may be made to the following descriptive matter and accompanying figures that describe and illustrate various configurations and concepts related to the invention.

DETAILED DESCRIPTION OF THE PREFERRED EMBODIMENTS

Figure 4:
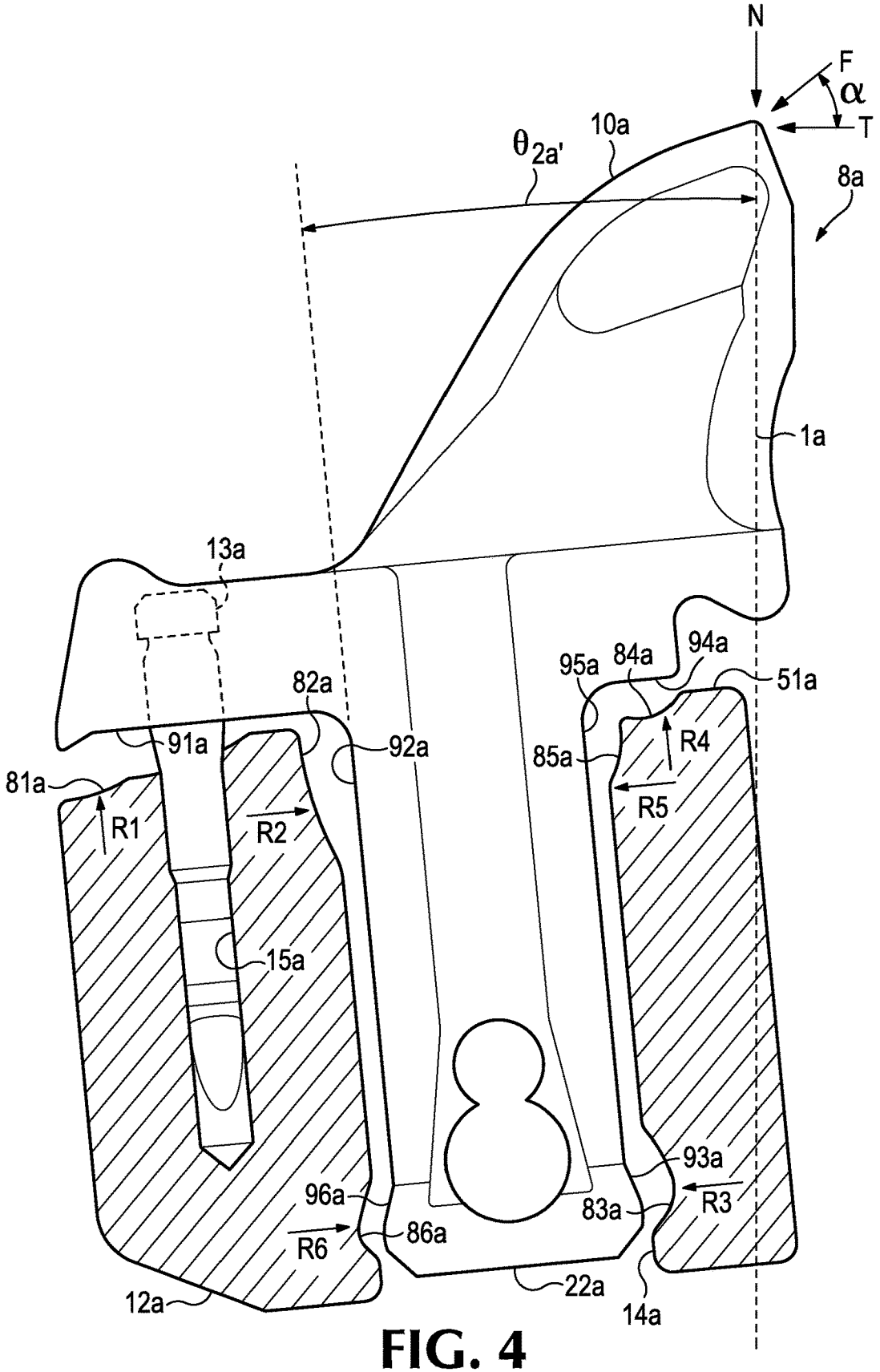
FIG. 4 (Prior Art)
FIG. 4 is a cross section of a prior art pick assembly including a pick and pick holder experiencing wear from tangential and normal loading.
Figure 7:
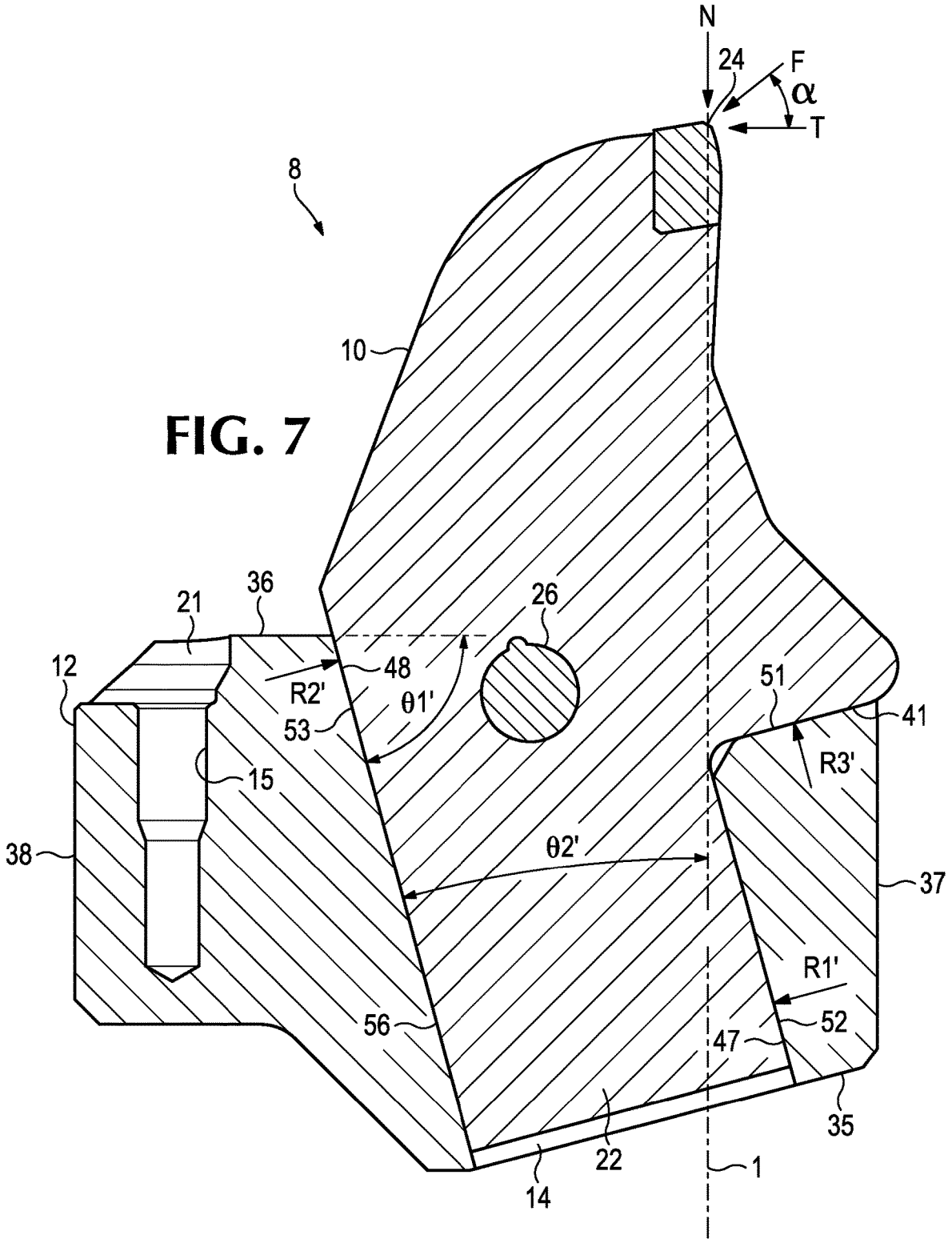
FIG. 7 is a vertical, axial cross section of the pick assembly from FIG. 6.
Figure 8:
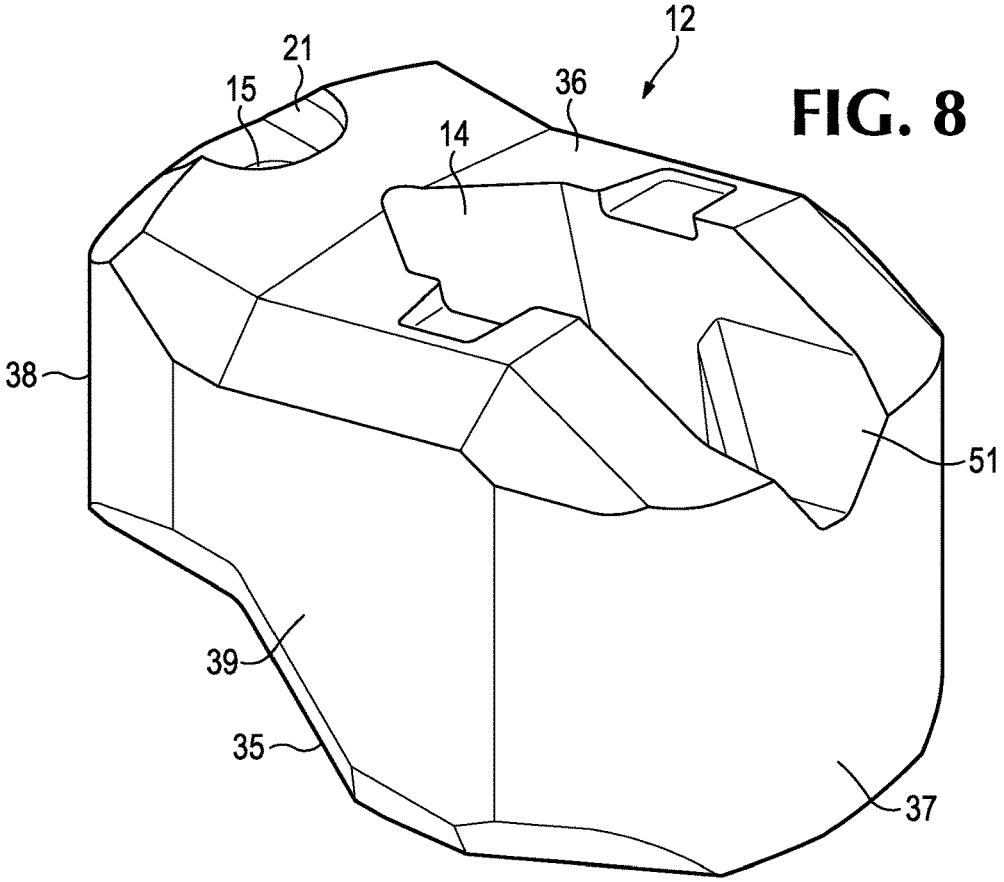
FIG. 8 is a front perspective view of the pick holder from FIG. 6.
Figure 9:
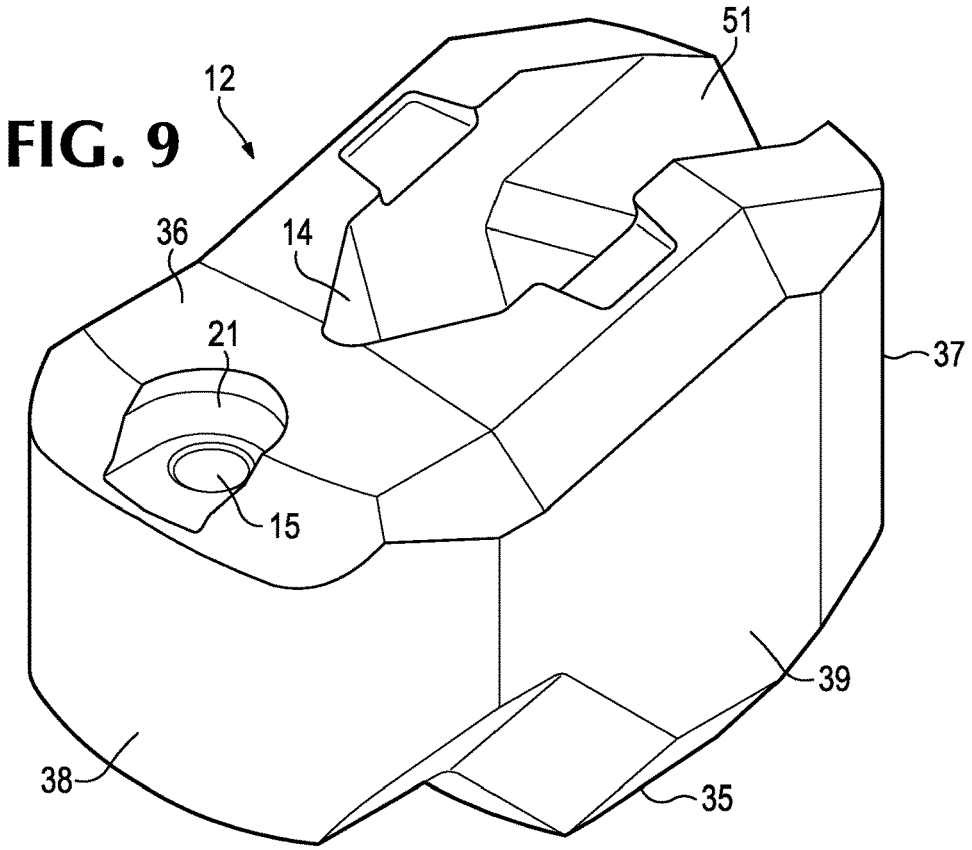
FIG. 9 is a rear perspective view of the pick holder from FIG. 6.
Figure 18:
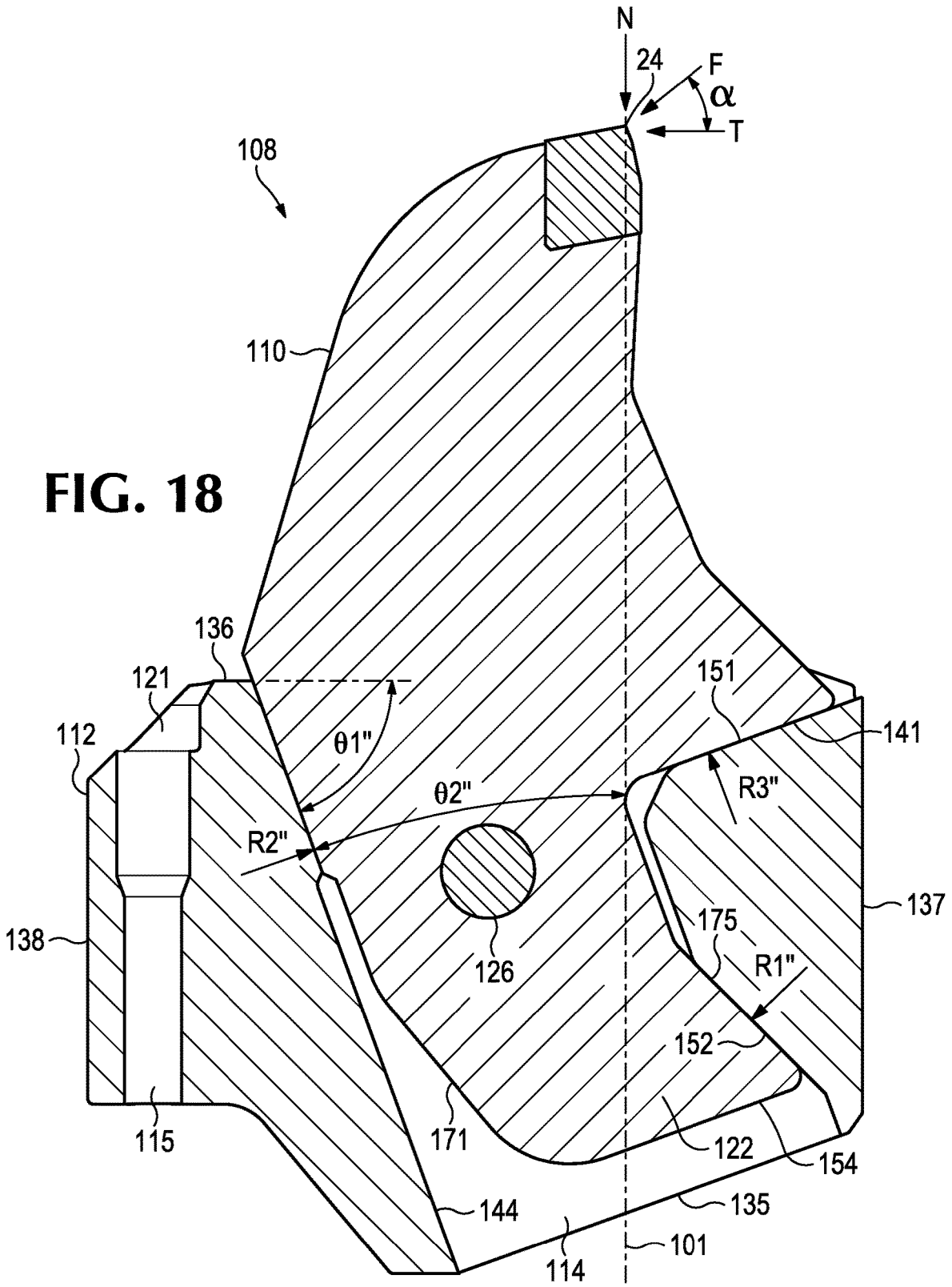
FIG. 18 is a vertical, axial cross section of the pick assembly from FIG. 17.
Figure 19:
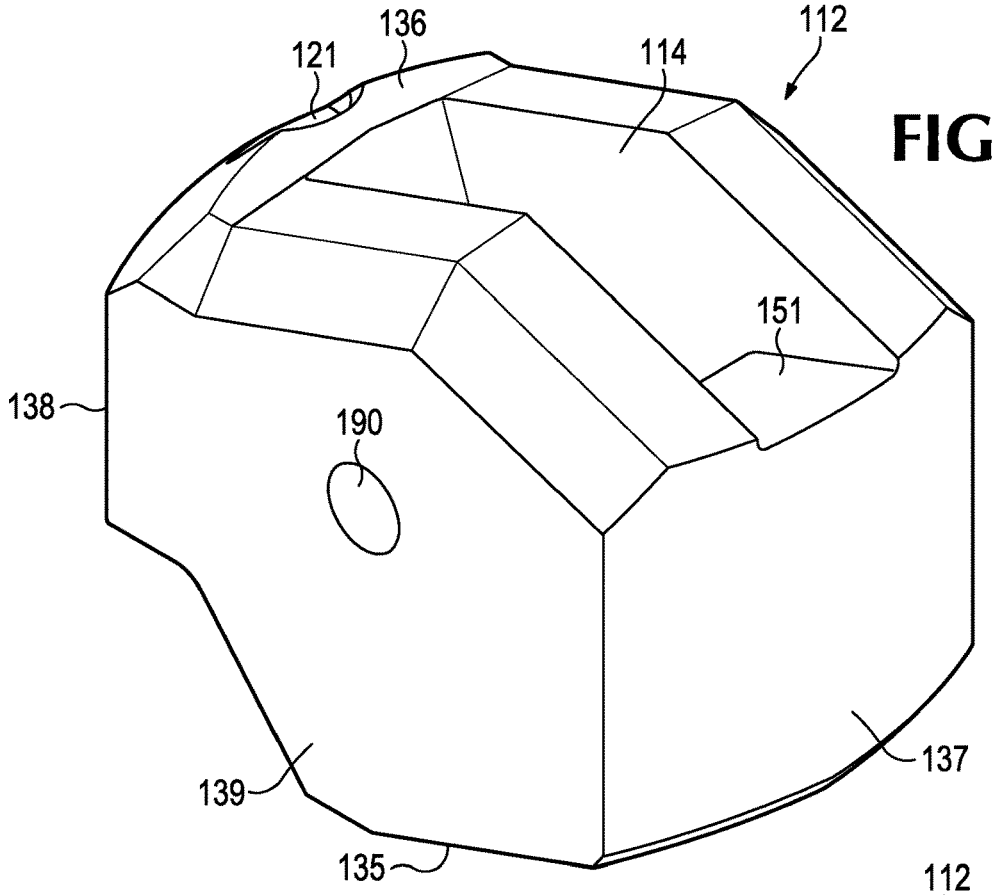
FIG. 19 is a front perspective view of the pick holder from FIG. 17.
Figure 20:
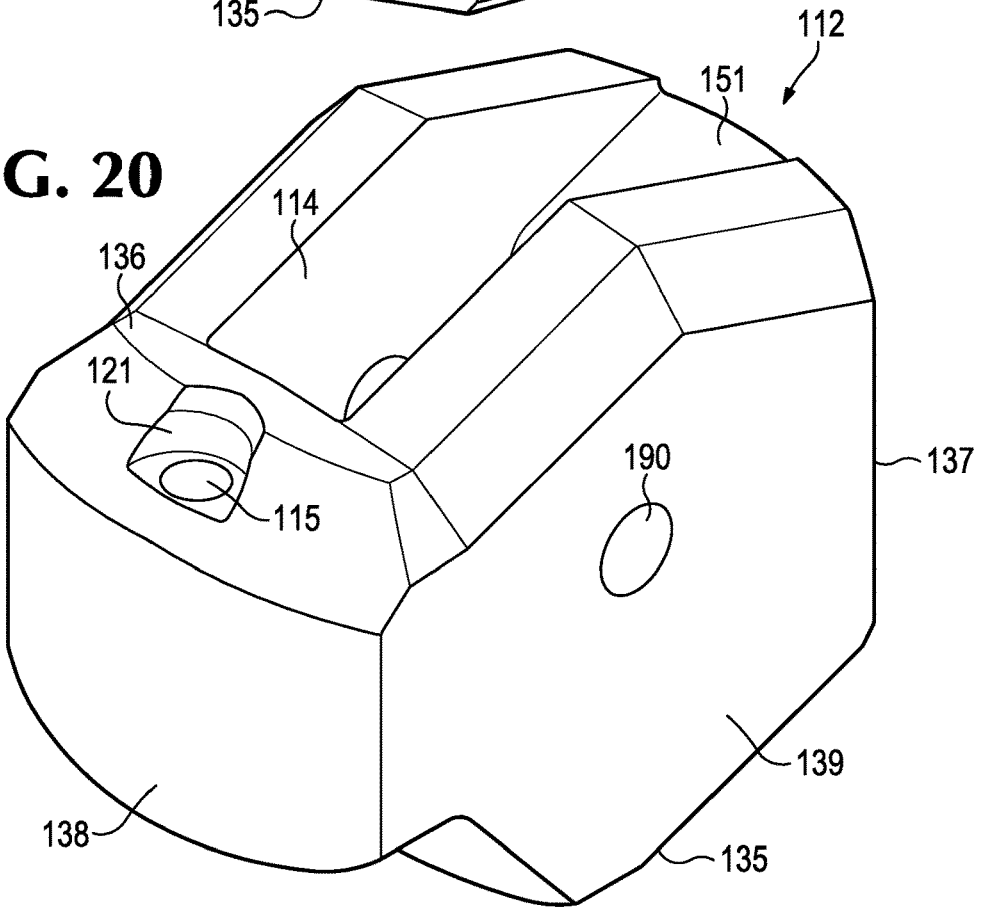
FIG. 20 is a rear perspective view of the pick holder from FIG. 17.

The present invention pertains to an improved pick and pick holder assembly for use, for example, in mineral winning in underground mining. Picks and pick holders can be used with a variety of applications including longwall shearer drums, continuous miner heads, and cutting chains. In this application, the invention is described in terms of a pick assembly for attachment to a shearer drum unless otherwise stated; nevertheless, the different aspects of the invention can be used in conjunction with other types of excavating applications. In this application, relative terms are at times used, such as front, rear, up, down, horizontal, vertical, etc., for ease of the description. Nevertheless, these terms are not considered absolute; the orientation of a pick and pick holder will change during operation. These relative terms should be understood with reference to the orientation of pick assembly as illustrated in FIGS. 4, 7 and 18 unless otherwise stated, i.e., wherein the carbide tip 24*a*, 24, and 124 is in the upper, front portion of the pick 10*a*, 10, and 110 that first impacts the material to be excavated.

Figure 1:
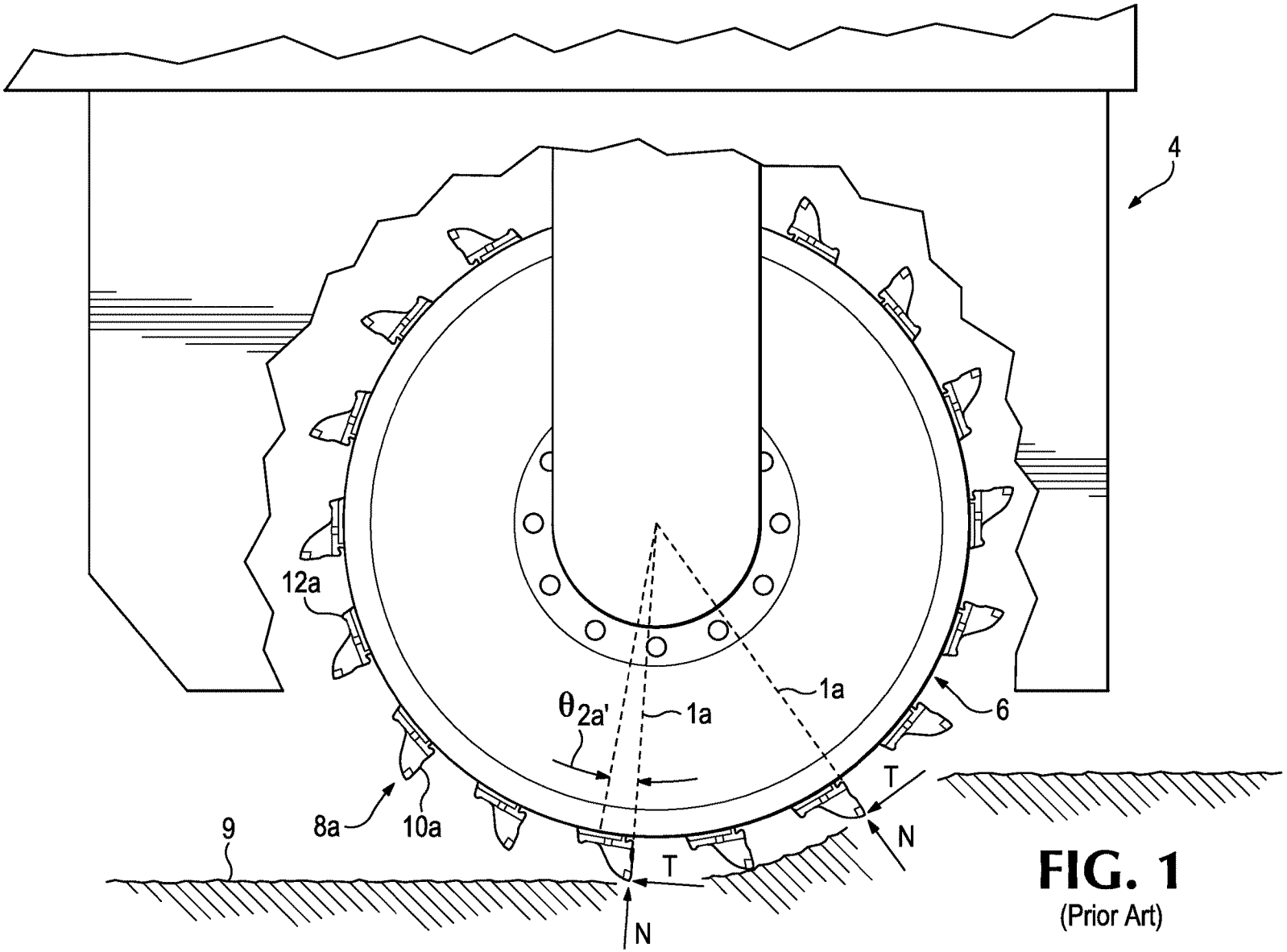
FIG. 1 (Prior Art)
FIG. 1 is a depiction of a prior art earth working operation including a roll with pick assemblies.

FIG. 1 depicts an earth working operation including a typical face miner with pick assemblies for extracting earthen material such as coal in a mining operation. The operation is shown as including a mining machine 4 with a driven roll or drum 6 mounted with pick assemblies 8*a*. Pick assemblies 8*a* include a pick 10*a* for impacting the ore seam or earthen material 9 as drum 6 rotates and a pick holder 12*a* to support picks 10*a*. Picks 10*a* are mechanically secured to pick holder 12*a*. Pick assemblies 8*a* are welded in a notch in drum 6. Pick assemblies 8*a* are typically mounted on drum 6 so that an opening 14*a* in pick holder 12*a* for holding a shank 22*a* of pick 10*a* has a small rearward inclination $\theta_{2a'}$ (i.e., within a range of 0.8 to 10 degrees) relative to line 1*a* which as discussed above is normal to the cutting path.

Earthen material to be extracted is typically in a consolidated seam. The rotating drum 6 passes across the mine face so the picks impact the face and dislodge material from the seam in manageable portions.

Picks 10*a* impinge on the material with speed and force to fracture and separate the consolidated material. The spacing of the picks determines the size of the dislodged material, but also is a factor in stress on individual picks and heating of components. The mined material is typically dropped onto a conveyor and moved away for further processing. Pick assemblies 8*a* are often attached to drum 6 in staggered rows. It is typical for each drum to be provided with 50 or more pick assemblies but it is possible for there to be fewer than 50 pick assemblies.

Figure 2:
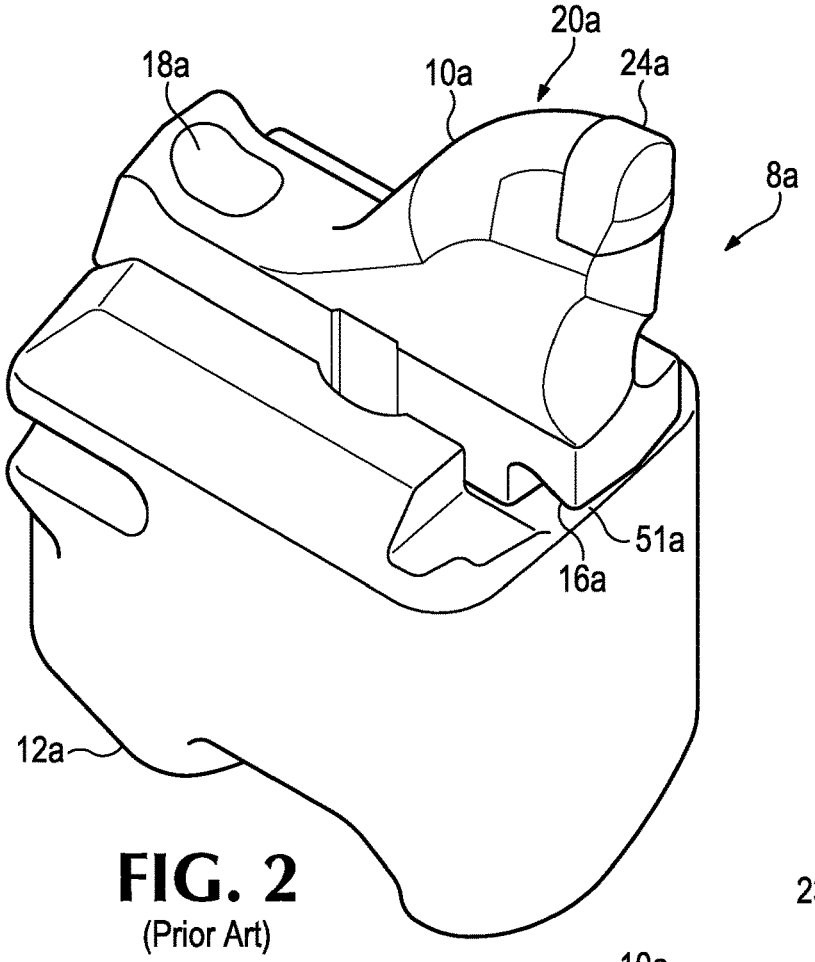
FIG. 2 (Prior Art)
FIG. 2 is a perspective view of a prior art pick assembly including the pick and pick holder.
Figure 3:
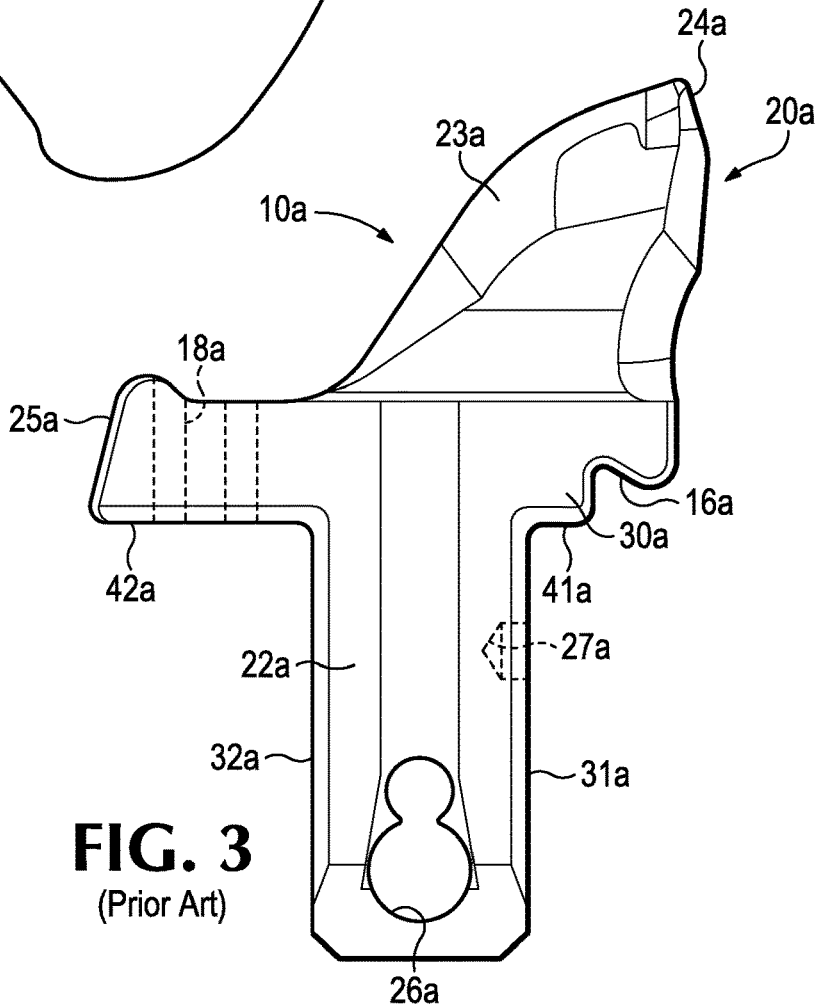
FIG. 3 (Prior Art)
FIG. 3 is a side view of a prior art pick.

FIGS. 2 to 4 illustrates a typical pick 10*a* and pick assembly 8*a* in common use. Pick 10*a* has a non-circular shank 22*a* having a linear rectangular transverse cross section adapted to be releasably located within a corresponding opening 14*a* in a pick holder 12*a*. The shank is releasably retained in the pick holder against inadvertent loss by a latching means, such as a multi-ribbed, synthetic plastics insert (not shown) in the double "O" aperture 26*a*. Numerous types of pick latching means are widely known. The front or leading face 31*a* of the shank 22*a* is optionally provided with a blind aperture 27*a* to receive a resilient, shank retaining button (not shown). From the upper end of the leading face 31*a* of the shank 22*a*, a forwardly directed shoulder 30*a* extends having an underside surface 41*a* to seat on a top bearing surface 51*a* of the associated holder 12*a* in the well known manner. Further forward, the shoulder 30*a* is provided with a pry point 16*a* for engagement by an extraction tool, such as a pry bar or drift, when extraction of the pick 10*a* is required. At trailing face 32*a* of the shank 22*a* is provided a heel 25*a* also having a support surface 42*a*, and in addition a duct 18*a* to accommodate a portion of a water sprayer 13*a* shown in FIG. 4. Beyond the shoulder 30*a* and heel 25*a* extends an integral blade 23*a* provided with a carbide tip 24*a*. Shoulder 30*a*, heel 25*a* and blade 23*a* comprise the head 20*a* of the pick 10*a*.

FIG. 4 depicts a typical pick holder 12*a* experiencing wear due to pick 10*a* encountering forces F that will at times have a force component that is predominantly normal (or inward) N, a force component that is predominantly tangential (or rearward) T, or a force component having both a tangential force component and a normal force component. Normal and tangential are relevant to the example of using a drum, but inward and rearward are more generally relevant to the drum and other applications such as a cutting chain assembly. The transfer of the forces during use creates cyclic reactionary forces R1-R6 on the pick holder 12*a*. As the forces F transitions between loads that have a predominantly rearward force component to loads that have predominantly inward force components, the bearing surfaces 91*a*-96*a* of pick 10*a* will not always be engaged against the corresponding bearing surfaces 81*a*-86*a* of pick holder 12*a*. When the resultant force F approaches tangential T (i.e., the force F has an angle α of approximately 0 degrees), the reactionary force the pick 10*a* exerts on the pick holder 12*a* will be primarily at R1-R3. When the force approaches normal N (i.e., the force F has an angle α of approximately 90 degrees from tangential T), the reactionary force will be primarily at R4-R6. As the pick impacts the material to be excavated the pick initially rocks rearward. As the angle α of the force transitions from approximately 0 degrees to approximately 90 degrees (i.e., as the force F transitions from having a predominantly tangential T component to having a predominantly normal N component) the bearing surfaces 81*a*, 91*a*, 82*a*, 92*a*, 83*a*, 93*a* at R1-R3 transition from being engaged to not being engaged (i.e., the force on the bearing surfaces goes from greater than 0 to equal to zero) and the bearing surfaces 84*a*, 94*a*, 85*a*, 95*a*, 86*a*, 96*a* at R4-R6 transition from not being engaged to being engaged. This causes pick 10*a* to rock forward and pick holder 12*a* to primarily experience wear at 84*a*, 85*a*, and 86*a*. As a new cycle of forces are experience the forces on the pick are unloaded and the bearing surfaces at R4-R6 transition from being engaged to not being engaged and the bearing surfaces at R1-R3 transition from not being engaged to being engaged. This causes pick 10*a* to again rock rearward and pick holder 12*a* to primarily experience wear at 81*a*, 82*a*, and 83*a*. As a result of the forces causing the pick 10*a* to rock within pick holder 12*a*, the pick holder 12*a* wears out prematurely.

Figure 26:
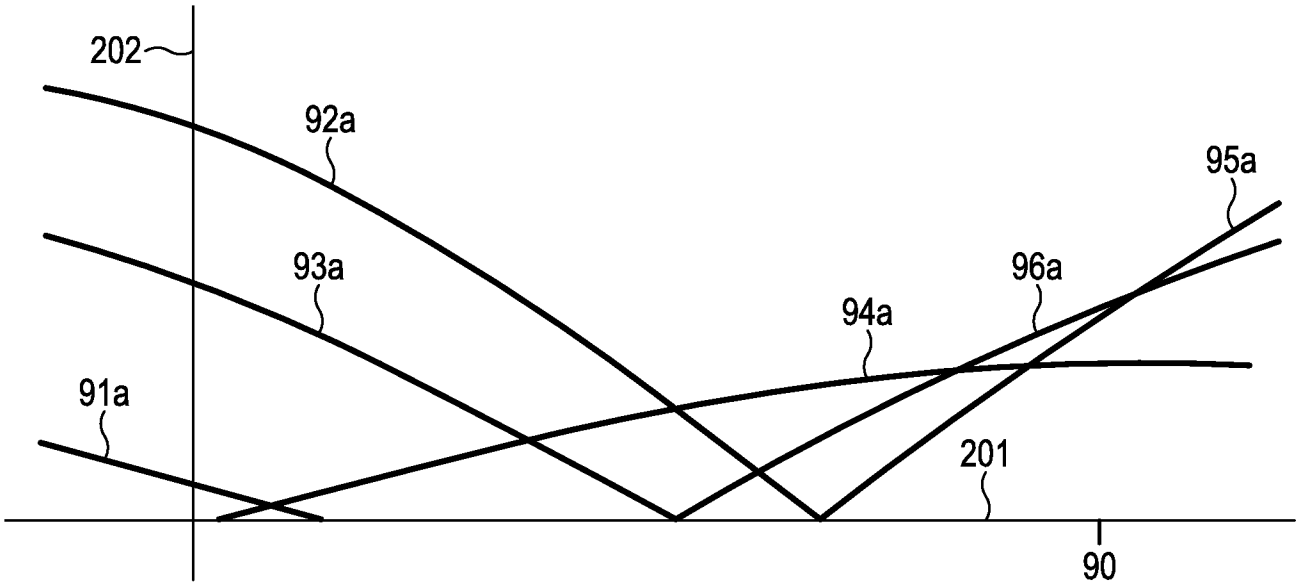
FIG. 26 is a graph depicting the loading of pick shank bearing surfaces of the pick shown in FIG. 4 as forces transition from normal to tangential.

FIG. 26 illustrates how the bearing surfaces will transition from being engaged to not being engaged as the force F on the pick transitions from having a primarily rearward or tangential T force component to having a primarily inward or normal N force component. As a pick rotates the pick will experience a force that will be primarily tangential to the strike point of the blade (i.e., having a force component that is primarily rearward on the pick), and as the pick continues to rotate the pick will experience a primarily normal N force component relative to the strike point of the blade (i.e., a force that is primarily inward on the pick). The x-axis 201 represents an angle measured from a force that is purely tangential (i.e., 0 degrees represents a force component that is purely tangential T and 90 degrees represents a force component that is purely normal N). The y-axis 202 represents the amount of force that a bearing surface of the pick experiences. It should be understood that when the input force sweeps from 0 degrees to 90 degrees the pick rocks when transitioning from bearing surface 91*a* to bearing surface 94*a*. It should be noted that there is a range that both bearings surfaces 91*a* and 94*a* may be engaged. Similarly, when the input force sweeps from 0 degrees to 90 degrees the pick rocks when transitioning from bearing surface 92*a* to bearing surface 95*a*, and when the input force sweeps from 0 degrees to 90 degrees the pick rocks when transitioning from bearing surface 93*a* to bearing surface 96*a*.

In accordance with a first embodiment of the invention shown in FIGS. 5-16, pick assembly 8 includes a pick holder 12, a pick 10, and a securement mechanism 26 to secure the pick 10 to the pick holder 12. The securement mechanism 26 may, for example, be a resilient retention feature as shown in FIGS. 12-16. The retention feature 26 may be a button inserted into a hole of shank 22 and configured to work cooperatively with the pick holder 12 to retain pick 10 in the pick holder 12. Alternatively, the securement mechanism 26 could be any type of lock known in the industry to secure the pick to the pick holder.

Figure 27:
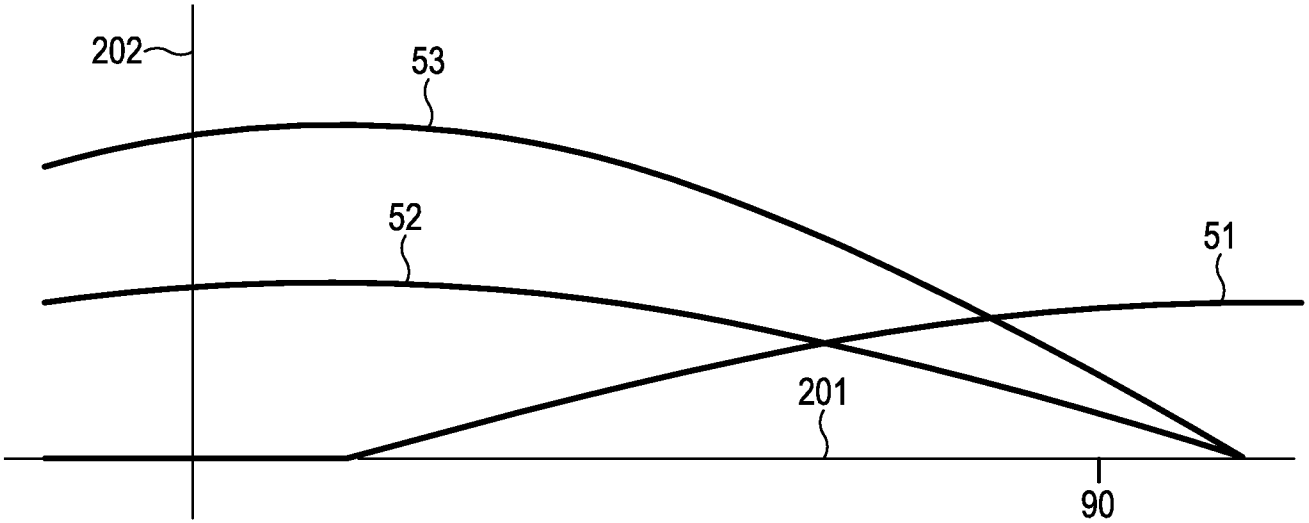
FIG. 27 is a graph depicting the loading of pick shank bearing surfaces of the pick shown in FIG. 6 as forces transition from normal to tangential.

In order to minimize the rocking of the pick within the pick holder the bearing surfaces have been optimized so that as the input force F on the pick shank transitions from having a primarily rearward (tangential) T force component to having a primarily inward (normal) N force component the bearing surfaces 52, 53 on the pick 10 and bearing surfaces 47, 48 on the pick holder 12 will remain engaged (i.e., the force on the bearing surface remains greater than or equal 0 as the resultant forces transitions between generally rearward and generally inward). Generally inward and predominantly inward are used to describe a force that is purely inward or a force that is plus or minus approximately 15 degrees from purely inward. Generally rearward and predominantly rearward are used to describe a force that is purely rearward or a force that is plus or minus approximately 15 degrees from purely rearward. This optimization can be seen in FIG. 27. The reaction forces on the bearing surfaces are greater than 0 when the input forces are between tangential (0 degrees) and normal (90 degrees). Preferably the reaction forces on the bearing surfaces remain greater than 0 when the input force F transition from an angle α of approximately −15 degrees to 105 degrees relative to Tangential T. There are several ways to optimize the shape of the pick and pick holder so that the bearing surfaces remain engaged. For example, the number of bearing surfaces can be minimized, the shank of the pick may be rearwardly inclined relative to an inward N force component (i.e., a force F with an angle α of 90 degrees), and or the shoulder on the pick may extend farther forward than the strike point of the blade (i.e., farther forward than line 1 which runs along a true inwardly-directed load applied to the strike point of the blade). In the embodiment shown in FIGS. 5-16 the number of bearing surfaces has been minimized, the shank has been rearwardly inclined relative to an inward force component, and the shoulder extends farther forward than the strike point of the blade. However, the pick may have any number of shapes and may, for example, only have the shoulder farther forward than the blade, only be rearwardly inclined, or have the number of bearing surfaces minimized such that all of the bearing surfaces in the pick remain engaged (i.e., the reaction force on the bearing surfaces always remain greater than 0) as the input forces on the pick transitions between generally rearward T and generally inward N (i.e., as the forces F transition from having an angle α of approximately −15 degrees to approximately 105 degrees relative to tangential T).

Figure 10:
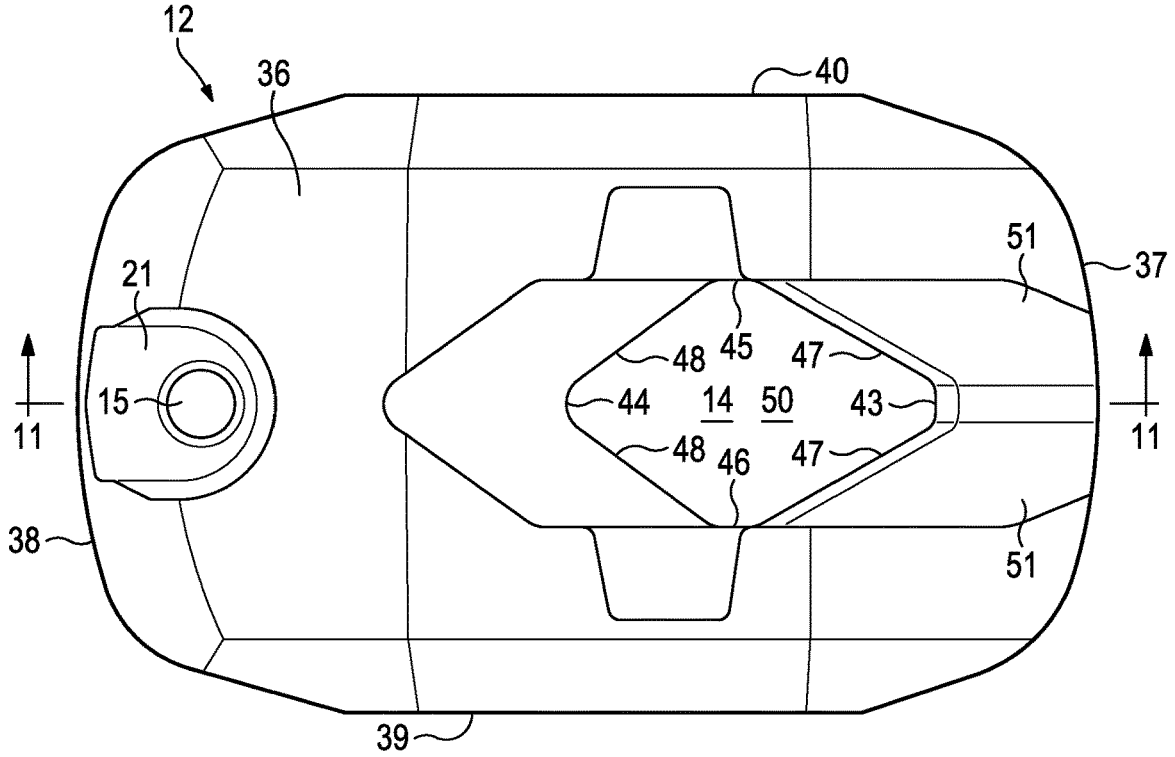
FIG. 10 is a top view of the pick holder from FIG. 6.
Figure 11:
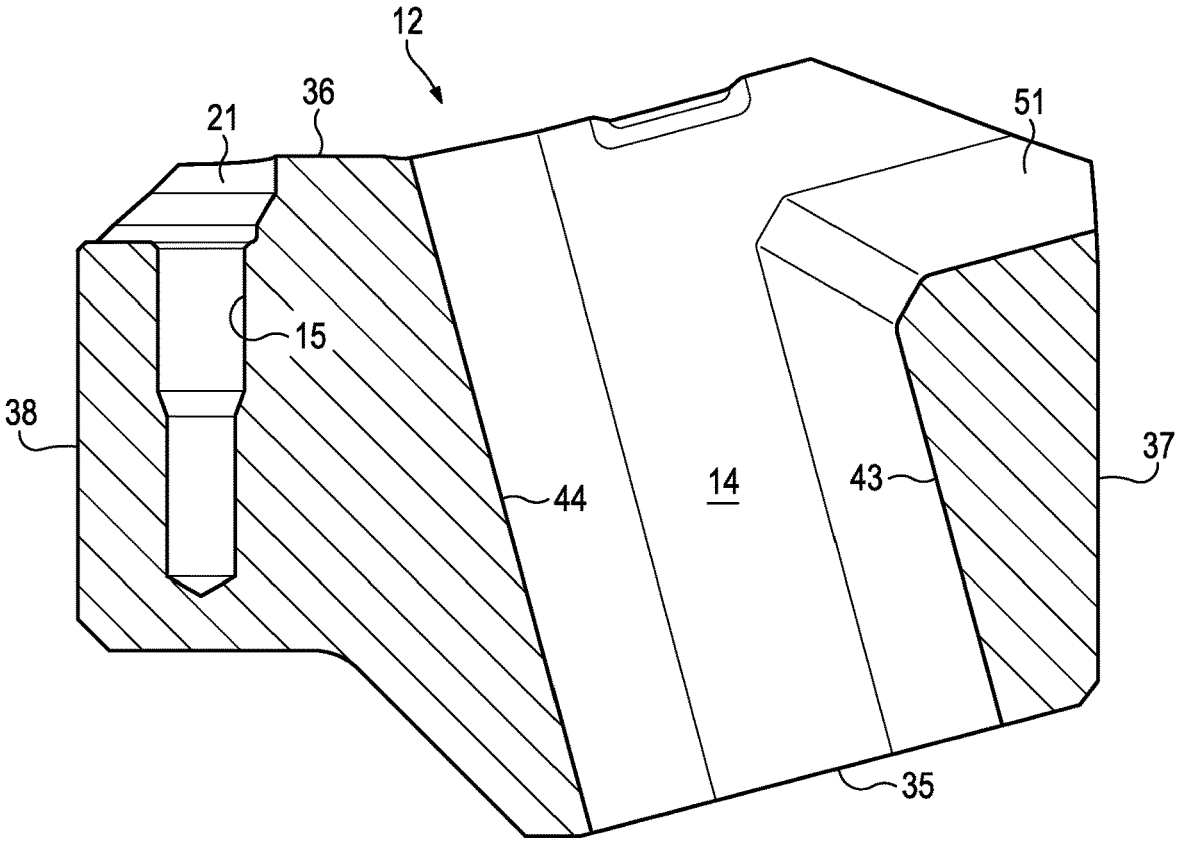
FIG. 11 is a cross section of the pick holder taken along line 11-11 in FIG. 10.
Figure 12:
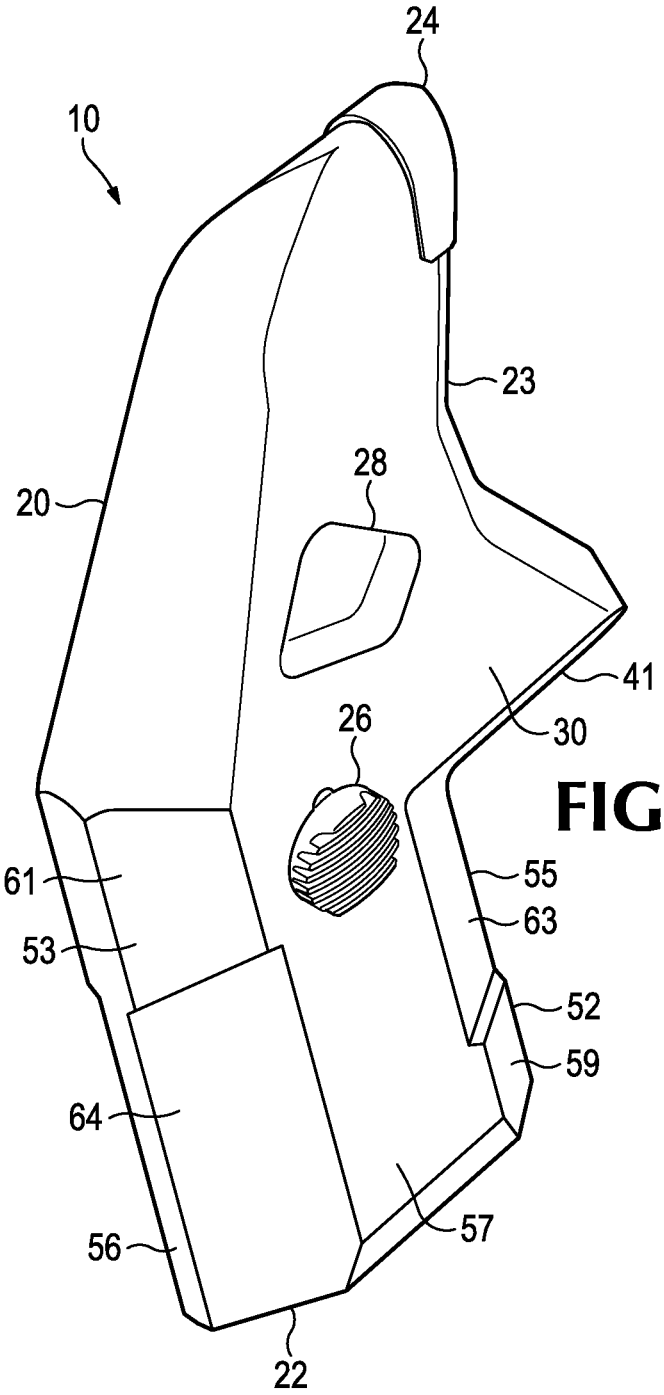
FIG. 12 is a rear perspective view of the pick from FIG. 6.

Pick holder 12 has a bottom surface 35, a top surface 36, a leading face 37, a trailing face 38, and side surfaces 39 and 40. The leading face 37, trailing face 38, and bottom surface 35 set against the drum 6, preferably in a notch 7, though other arrangements are possible. The pick holder is preferably welded to the drum 6 in notch 7. Opening 14 extends from the bottom surface 35 to the top surface 36 and preferably through a central region of pick holder 12. Opening 14 comprises front and rear corner surfaces 43 and 44, and side surfaces 45 and 46. Opening 14 supports pick 10 and has the same general shape as the received portion of pick 10. As can be seen in FIG. 10, opening 14 includes a shank-receiving portion 50 having a generally diamond shape with laterally inclined surfaces 47, diverging in a rearward direction and that meet at front corner surface 43, and laterally inclined surfaces 48 diverging in a forward direction that meet at rear corner surface 44. The laterally inclined front and rear surfaces 47, 48 are preferably V shaped. Other shapes could be used. The front and rear 'V' shaped surfaces 47 and 48 increase the bearing area between the holder 12 and the pick 10, provide added stability, and reduces surface pressure. The inclined front and rear surfaces 47, 48 also resist rearward loads that are axial and those with side components on the same surfaces to reduce movement of the pick shank 22 in the opening 14 as the loads on the pick 10 shift during use.

Figure 5:
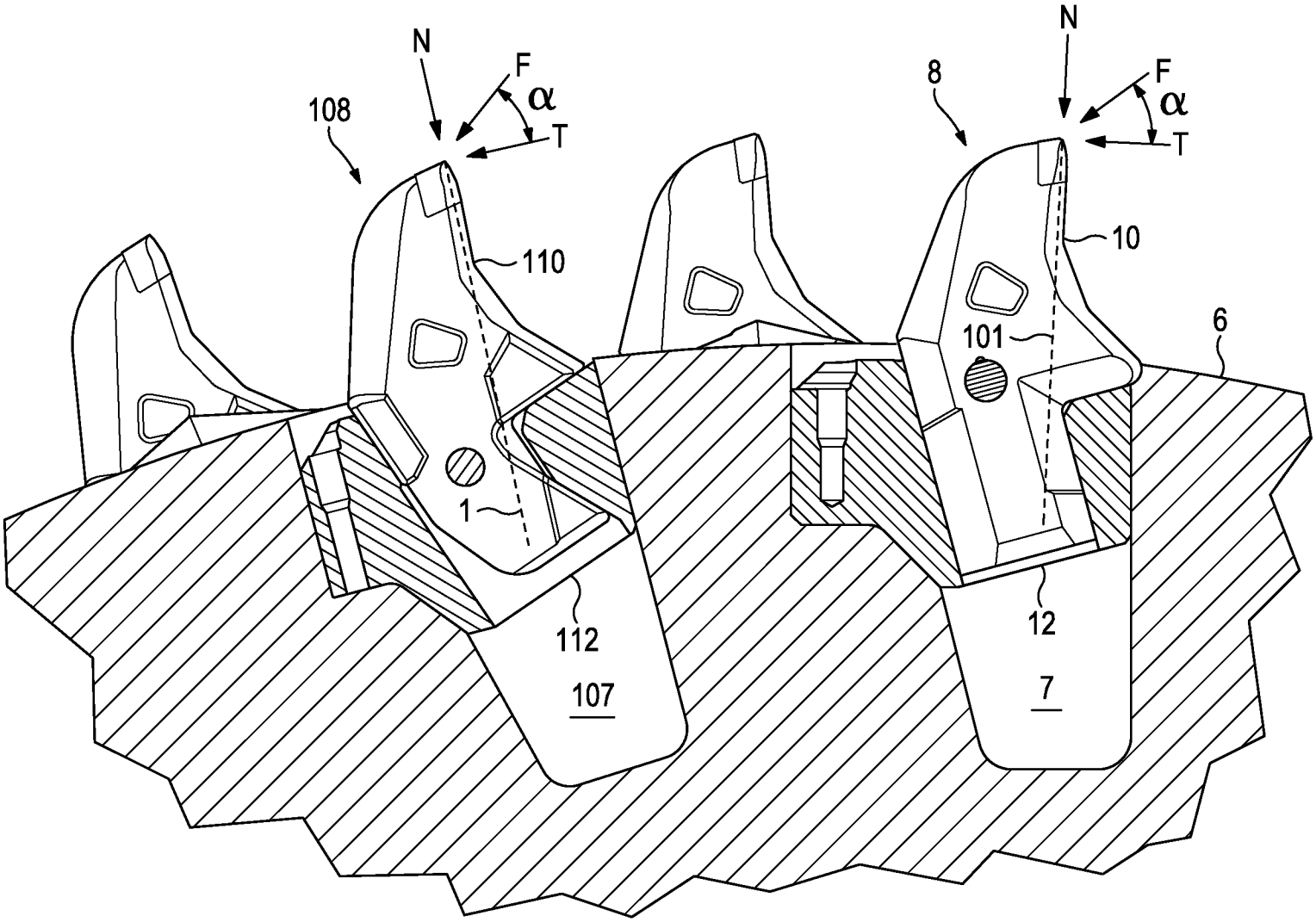
FIG. 5 is a depiction of a cross section of a shearer drum with two different embodiments of picks of the present invention.
Figure 6:
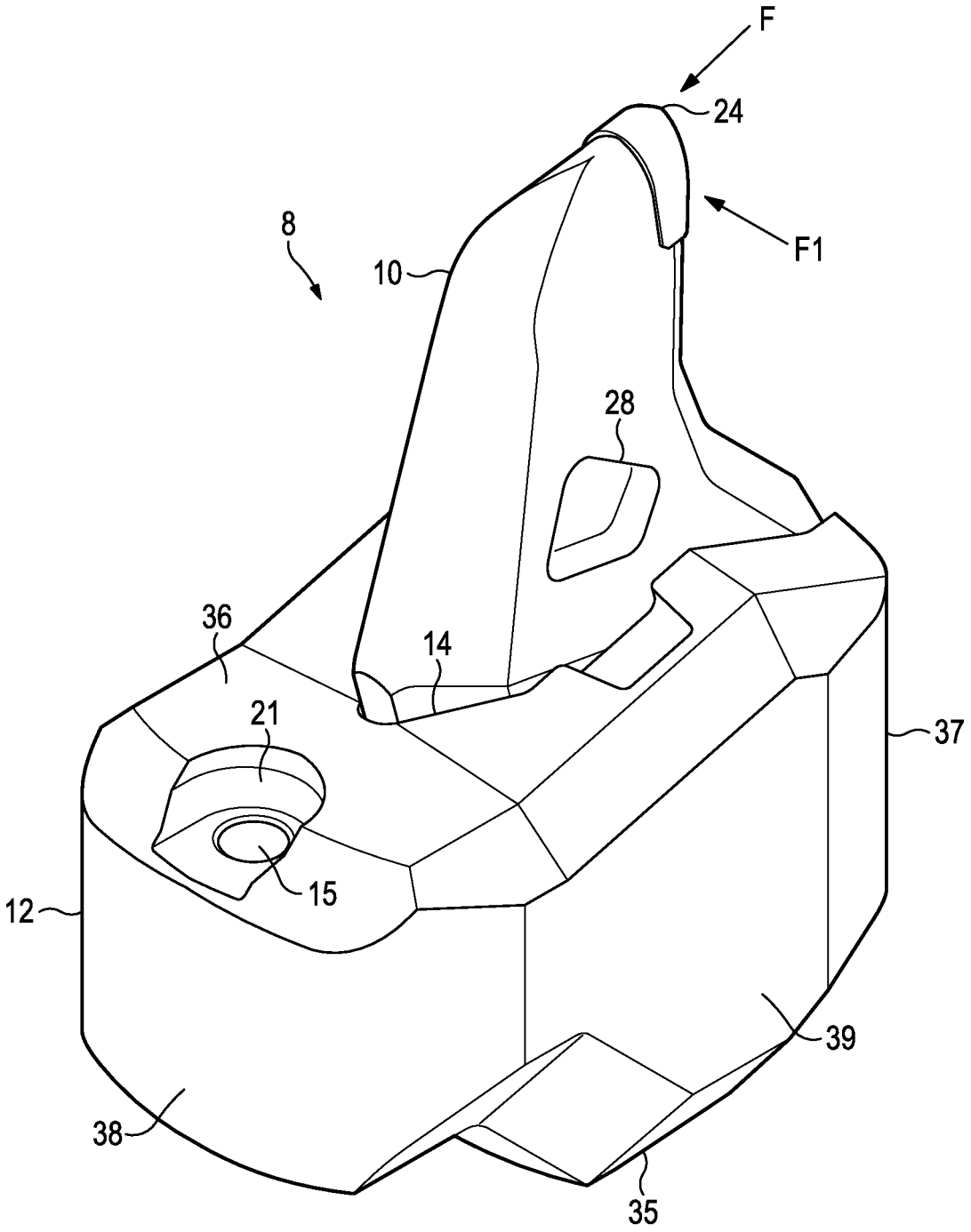
FIG. 6 is a rear perspective view of a pick assembly including a pick and holder of the present invention experiencing a force with a transverse component and a force between tangential and normal.

Opening 14 is preferably rearwardly inclined relative to a force F having a purely normal or inward N force component (such as along a line 1 normal to the tip 24 with respect to the material face and orthogonal to the frontal direction of motion) as seen in FIGS. 5 and 7. In the example of using a drum, line 1 extends normally through the strike point of the tip 24 to the center of rotation of the pick assembly around the drum 6. The angle θ2' of the rear surfaces 48 of the pick holder to a force F with a purely inward N force component on the pick is preferably in the range of about 11-35 degrees. However, in some embodiments the opening 14 may be rearwardly inclined so that θ2' will be within a range of 13-35 degrees, or could be larger than 35 degrees or smaller than 11 degrees. In one preferred example, angle θ2' is about 15 degrees. As discussed below, this orientation allows the pick 10 and pick holder 12 to better resist the expected loading and reduces wear between the components, and particularly on the pick holder. The upper surface 36 preferably sets along or below the drum surface, i.e., in notch 7 (FIG. 5). Accordingly, in a preferred example, opening 14 is also forwardly declined from top surface 36 of pick holder 12 with an angle θ1' of about 55-80 degrees, however, in some embodiments the angle θ1' could be larger than 80 degrees or smaller than 55 degrees. In one preferred embodiment opening 14 is forwardly declined from top surface 36 with an angle θ1' of about 75 degrees.

Pick holder 12 has top bearing surfaces 51 that are preferably recessed from the top surface 36 of pick holder 12 near leading face 37. Top bearing surfaces 51 are preferably inclined forward relative to normal line 1 so as to extend generally perpendicular to rear surfaces 48.

Top bearing surfaces 51 are also preferably formed as laterally inclined surfaces, diverging in an outward direction. Top bearing surfaces 51 are preferably 'V' shaped and taper downward (i.e., inward), though other shapes are possible. Top bearing surfaces 51 abut against corresponding underside bearing surfaces 41 of pick 10. The 'V' shaped top bearing surfaces 51 increase the bearing area between the pick holder 12 and the pick 10 and reduce the surface pressure between the pick 10 and the pick holder 12. The 'V' shaped top bearing surfaces 51 provides additional stability and minimizes the movement of pick 10 within pick holder 12 when the pick 10 is subjected to side forces. The reduced movement of pick 10 within pick holder 12 and the reduced contact pressure between parts increases the life of each component of the pick assembly.

In a preferred embodiment, top bearing surfaces 51 of pick holder 12 are lined with hard-facing material. The hard-facing material further extends the life of the pick holder 12 by adding additional wear resistance where the pick 10 exerts reactionary force R3' on the pick holder 12. The pick holder may also be lined with hard-facing where the pick exerts reactionary forces R1' and R2' on the pick holder, where the pick holder experiences wash, where the pick lock is maintained in the pick holder, and other locations on the pick holder that experience wear.

Pick holder 12 also preferably has a duct or bore 15 extending from the bottom surface 35 along trailing face 38 to the top surface 36 of holder 12. In some instances, bore 15 may be a blind bore extending from top surface 36 that adjoins a blind bore extending from the trailing face 38 or one of the side surfaces 39 or 40 (not shown). Bore 15 may be located in the shadow of pick 10, but could be located elsewhere. Bore 15 has a counterbore 21 at the top surface 36 of holder 12 for receiving a low profile water sprayer (not shown) for spraying the head 20 of the pick 10 and the coal with water. The counterbore 21 and bore 15 allows the low profile water sprayer to sit within pick holder 12 so that only a small portion of the water sprayer extends above the top surface 36 of pick holder 12. The small portion of the water sprayer extending above pick holder 12 may further be protected during normal operation by being in the shadow of pick 10. The low profile water sprayer reduces the likelihood of premature breakage when a pick head 20 becomes broken and is ejected rearward. Pick holder 12 may be made via any known manufacturing method including casting or forging.

Pick 10 includes a shank 22 to maintain pick 10 in pick holder 12, and a head 20 to impinge on the material to be excavated with speed and force to fracture and separate the material. Pick 10 may be made via any known manufacturing method including casting or forging. Shank 22 and head 20 are aligned in a plane coincident with each other. In addition, a majority of pick assemblies on the excavating equipment have a head and a shank that are generally in a plane coincident with the direction of travel to impact the material to be excavated. Shank 22 is maintained within opening 14 in pick holder 12 with a conventional latching arrangement or securement mechanism 26. In use, pick 10 is driven along a path defined by the equipment and experiences forces F when the pick engages the mine wall. The forces F will at times be directly or purely inward or normal N (i.e., only an inward force component having and angle α of 90 degrees from tangential T) as tip 24 engages the ground. At other times the force F will be directly or purely rearward or tangential T (i.e., having an angle α of 0 degrees). Other times the input force will have an angle α from tangential having an inward and rearward force component (i.e., a force between tangential T and normal N) As outlined above, the various forces tend to make the shank in a conventional pick, like shank 22*a* in pick 10*a*, rock within the pick holder opening. To minimize undesired movement of the pick 10 within the pick holder 12, shank 22 remains positively engaged with the pick holder 12 along the same front and rear bearing surfaces regardless of whether the loads F have a predominantly inward force component (i.e., normal N) or a predominantly rearward force component (i.e., rearward T). In the present example of a pick assembly 8 secured to a drum, a line 1 extends normal to the strike point of the tip 24 with respect to the material face and orthogonal to the frontal direction. Shank 22 is preferably rearwardly inclined relative to a force F that that has a purely inward force component on the tip of the pick (i.e., when the force F has an angle α equal to 90). In one preferred embodiment, the shank is rearwardly inclined relative to line 1 with at an angle θ2' of about 11-35 degrees. Line 1 runs along a true inwardly-directed load applied to the distal end of the head and the shank is oriented to intersect line 1. In the example of a pick on a drum, the underside bearing surface extends forward of a line extending normally through the strike point of the tip to the center of rotation of the pick assembly around the drum. Line 1 is collinear with a force F having a purely inward N force component. However, in some embodiments the shank 22 may be rearwardly inclined so that θ2' will be within a range of 13-35 degrees, or could be larger than 35 degrees or smaller than 11 degrees. In one preferred embodiment, shank 22 is rearwardly inclined from a force F with a purely inward force component (in this example, normal line 1) with an angle θ2' of about 15 degrees. The rearward inclination of the shank 22 adds stability by giving the pick 10 a natural tendency to abut the front wall 43 and the rear wall 44 within the pick holder 12 for the usual expected forces pick 10 will encounter. Shank 22 remains engaged with the pick holder even if the forces F on the pick head 20 are generally inward (i.e., a force with a predominantly normal N force component) or rearward (i.e., a force with a predominantly tangential force component). Shank 22 is supported in opening 14 of pick holder 12 and has the same general shape as opening 14. While a pick with a rearwardly inclined shank and a forwardly inclined head as disclosed achieve this beneficial fit between the pick and the pick holder, other arrangements are possible.

Figure 15:
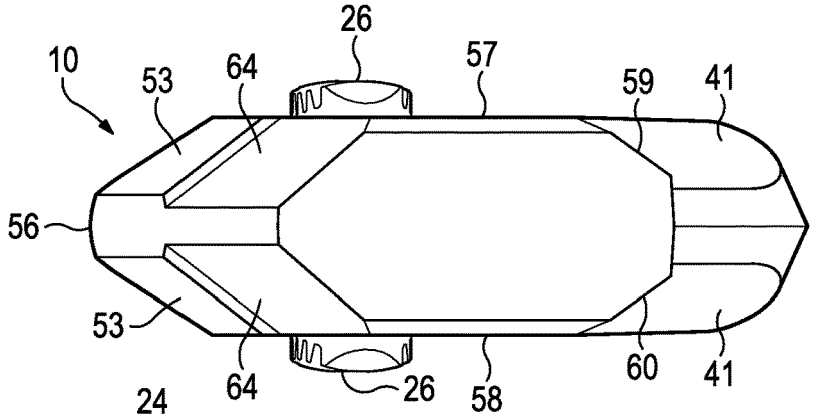
FIG. 15 is a bottom view of the pick from FIG. 6.
Figure 14:
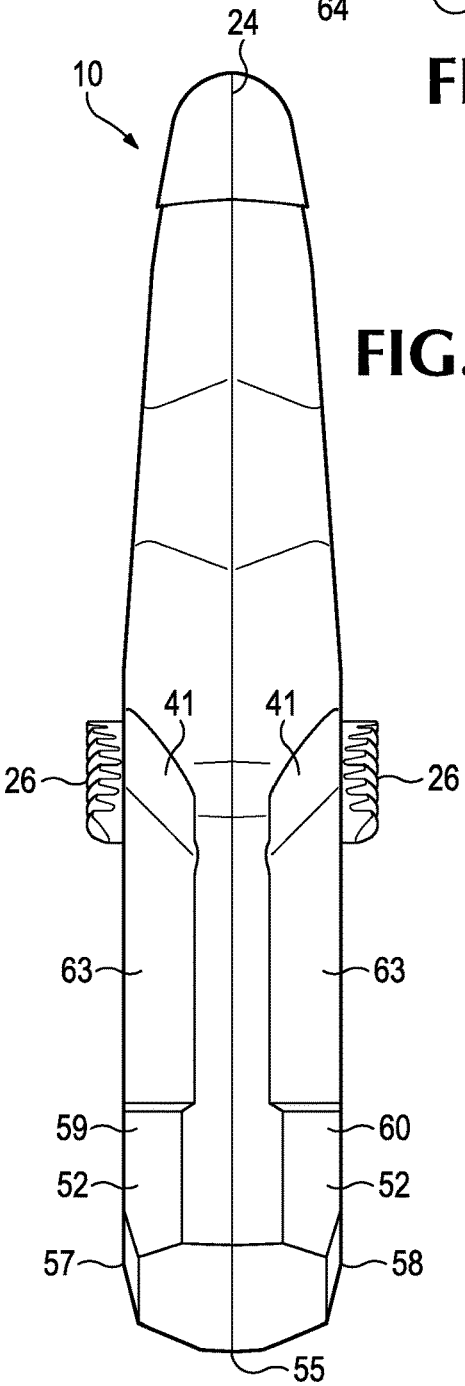
FIG. 14 is a front view of the pick from FIG. 6.
Figure 16:
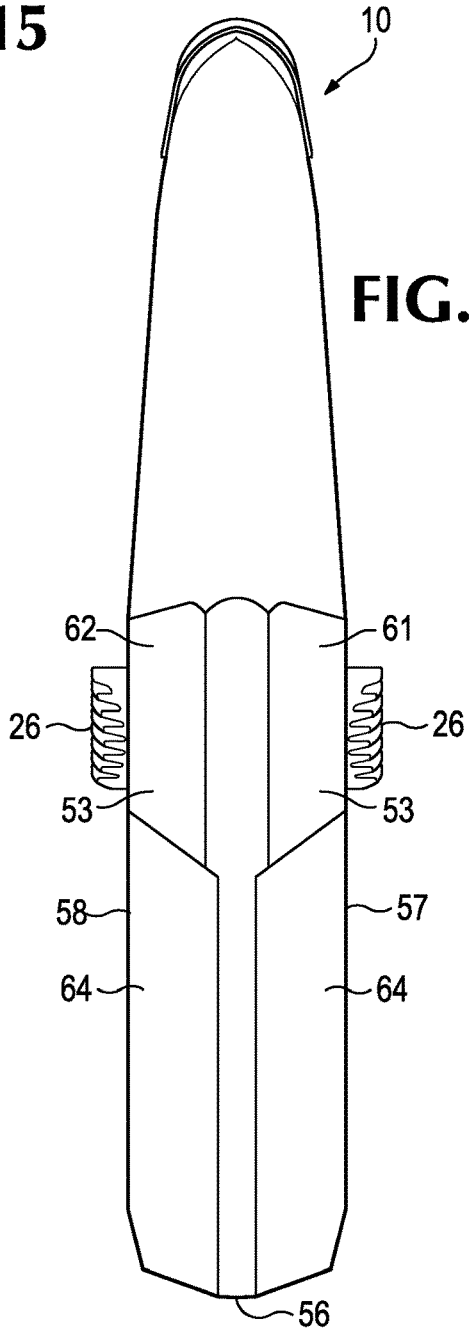
FIG. 16 is a rear view of the pick from FIG. 6.
Figure 17:
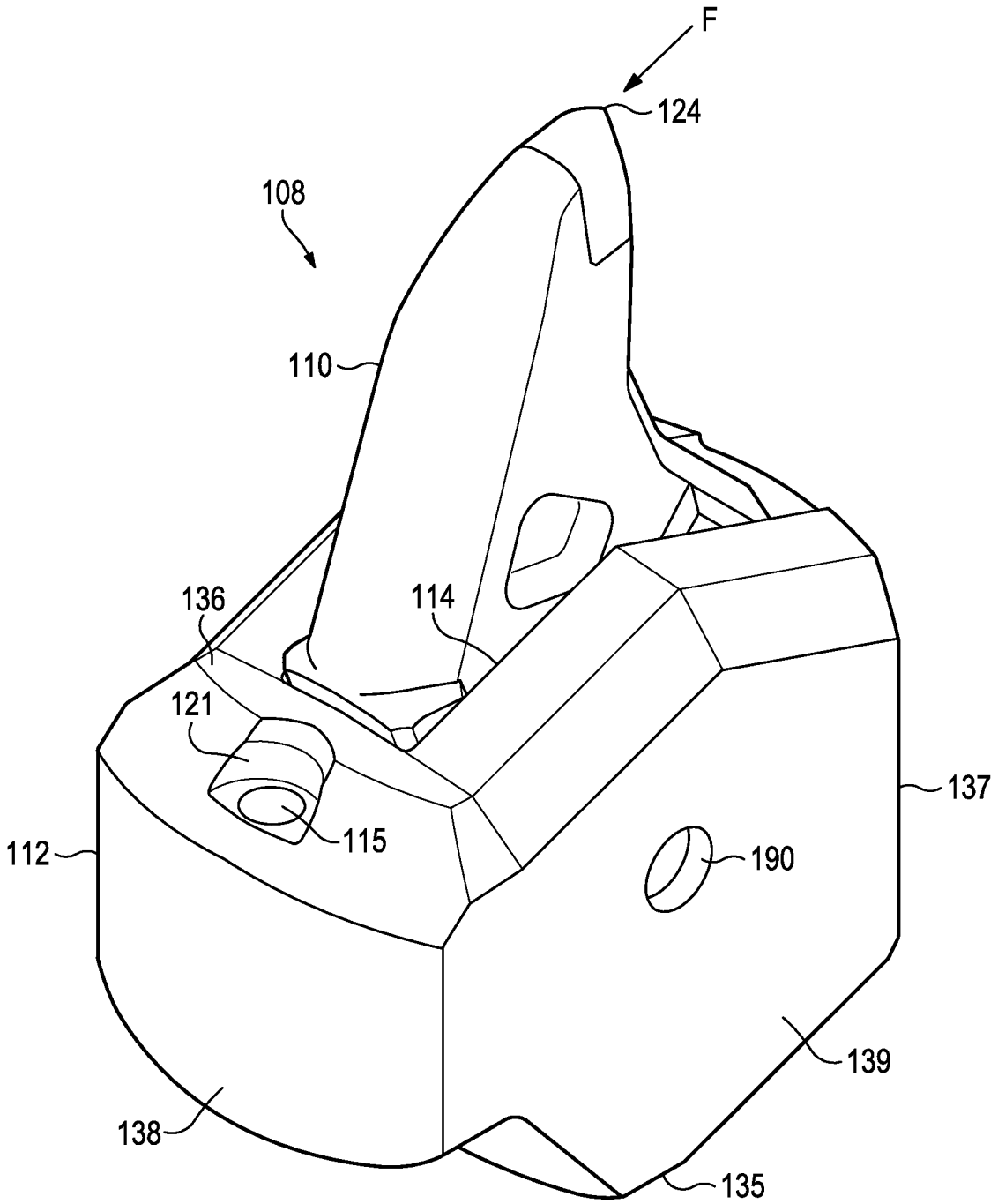
FIG. 17 is a rear perspective of an alternative pick assembly of the present invention.

Shank 22 comprises a front end 87 generally facing in a forward direction, a rear end 88 opposite the front end and generally facing away from the forward direction, and side surfaces 57 and 58 extending between the front and rear ends 87 and 88. As can be seen in FIGS. 14-16, shank 22 preferably has a generally diamond shape with front and rear corners 55 and 56 and laterally inclined front surfaces 59, 60 that diverge rearwardly as they extend toward side surfaces 57 and 58 to complement and bear against front bearing surfaces 47 in the opening 14. Accordingly, front surfaces 59, 60 are preferably planer and V shaped and meet at front corner surface 55. Shank 22 also includes laterally inclined rear surfaces 61, 62 that converge as they extend away from side surfaces 57 and 58 and meet at rear corner surface 56 to complement and bear against rear bearing surfaces 48 in opening 14. Rear surfaces 61, 62 preferably define V shaped rear bearing surfaces. Other shapes could be used, and for example the V shaped front and rear surfaces 59-62 may be generally curved or arched. The front and rear 'V' shaped surfaces 59-62 increase the bearing area between the holder 12 and the pick 10, provide added stability, and reduce surface pressure. Other ways of increasing the surface area of the shank may be used and, for example, the front and/or rear surfaces 59-62 may have an inverted V shape so that the opposing surface in each pair of surfaces 59, 60 and 61, 62 converge toward each other as they extend toward the center of the shank. The inclined front and rear surfaces 59-62 also resist side loads, generally normal loads, and generally tangential loads on the same surfaces to reduce shifting of the pick shank in the opening as the loads on the pick shift during use. The reduced shifting may increase the ability of the blade and the carbide tip of the pick to better withstand the wash of material flow as the pick engages the ground and reduces the wear of the pick on the pick holder.

Head 20 of pick 10 comprises a blade 23 and shoulder 30. Blade 23 has a tip 24 at the top leading face 31 to impact and separate the material to to be excavated. One or more sides of blade 23 may be provided with a recess 28. Recess 28 is designed to be engaged by a pry tool to pry the pick 10 from the pick holder 12. Recess 28 is shown as generally rectangular. However, the recess does not have to be rectangular and may, for example, be triangular, circular, or any number of other shapes and may, for example, extend completely through the head. In addition, other pick removal techniques may be used and the pick 10 may not be removed with a pry tool or be provided with any recesses 28.

Shoulder 30 extends below blade 23 primarily to resist inwardly directed loads (i.e., a force F having a large inward N force component). Shoulder 30 along with shank 22 stabilizes the pick 10 within the pick holder 12. Shoulder 30 preferably extends farther forward than blade 23 to minimize the shifting the pick experiences as the forces on the pick are generally inward. When the shoulder 30 extends farther forward than blade 23 the shank is preferably rearwardly inclined so that the shape of the blade 23 and shoulder 30 may be optimized for the angle of attack and increased wear life. In addition, having a rearwardly inclined bearing surface and a shoulder that is forward of the blade and generally perpendicular to the rear bearing surface of the shank allows both the rear bearing surface and the shoulder to withstand the inward forces applied to the pick.

Shoulder 30 has one or more underside bearing surfaces 41. Underside bearing surfaces 41 are preferably oriented relative to rear surfaces 61, 62 within a range of about 75 to 115 degrees (when measured from the rear surface counterclockwise to the underside bearing surface) to resist generally normal forces and movement of the pick within the pick holder. Other angular orientations are possible. A shoulder angled toward the larger end of the range can provide sufficient clearance for a broader arc between the shoulder and the shank. In one preferred embodiment, underside bearing surfaces 41 are forwardly inclined 105 degrees to rear surfaces 61-62 to control the fracture force outlined below.

Underside bearing surfaces 41 are preferably laterally inclined so as to diverge outward (e.g., normally outward) to complement and bear against top bearing surfaces 51 on holder 12. The widest portions of the bearing surfaces 41 of the pick 10 are preferably constrained to have a width that is generally less than or equal to the width of the shank 12, but may have a width that is wider than the shank. The top bearing surfaces 51 of the pick holder 12 and the underside bearing surfaces 41 of the pick are offset from the top surface 36 of the pick holder 12 so that the underside bearing surfaces 41 bear against an internal surface of the pick holder 12. In this example, bearing surfaces 41 are 'V' shaped. Other shapes could be used. Top and underside 'V' shaped bearing surfaces 41 and 51 increase the bearing area, provides stability from side forces, and reduces the surface pressure the pick exerts on the pick holder.

Head 20 is preferably free of a heel enabling the bearing surfaces 47 and 48 of the opening 14 in the pick holder 12 to more fully bear the reactionary forces experienced when the force F has a generally tangential T force component and when the force F has a generally normal N force component and reduces the rocking between the pick and the pick holder. A head free of a heel at the rear of the trailing face 32 reduces the amount of material within the pick 10 and the stress under certain loading. The head 20 also preferably eliminates any connection between the pick 12 and the water sprayer reducing the likelihood of premature breakage of the water sprayer.

Pick 10 is preferably designed with a break point below the shoulder 30 and is designed to break where the head 20 meets the shank 22 when subjected to fracture forces. This allows shank 22 to be easily removed by pushing shank 22 through the bottom of opening 14 within the pick holder 12 and removing the shank 22 through notch 7 in drum 6. Front V shaped surfaces 59, 60 and V shaped bearing surfaces 41 on shoulder 30 converge to a narrow front corner surface 89. The use of such a narrow front end functions (along with the benefits discussed above) to limit the strength of the pick by creating a natural point of high stress at front corner surface 89. When an extreme load is met during use, such as the striking of a metal support in the mine wall, the high stress at front corner surface 89 causes the shoulder 30 to break away from the shank 22. Adjusting the geometry of the narrow front corner surface 89 will vary the fracture force required to separate the shoulder from the shank. The use of these V shaped front surfaces 59, 60 below the V shaped bearing surfaces 41 in the shoulder ensure complete separation of the shoulder from the shank. In addition, the pick may have a thinner thickness where the shoulder meets the shank or could be made with a material that is not as strong as the adjacent portions of the pick to further control the high point of stress and ensure that the shoulder separates from the shank when the pick experiences a fracture force. Other ways of creating a point of high stress could be used to separate the shank from the shoulder, for example, there may be a recess or notch of cut out material provided on the leading edge of the pick where the head meets the shank in accordance with POT application PCT/IB2012/001988 filed Aug. 8, 2011 entitled "Cutter Tool," which is incorporated herein by reference in its entirety. However, the leading edge of the pick at the juncture of the shank and the head is preferably free of any recesses or notches of cut out material; rather, the narrow front corner surface 89 itself causes the head to be broken from the shank when subjected to fracture forces.

Figure 13:
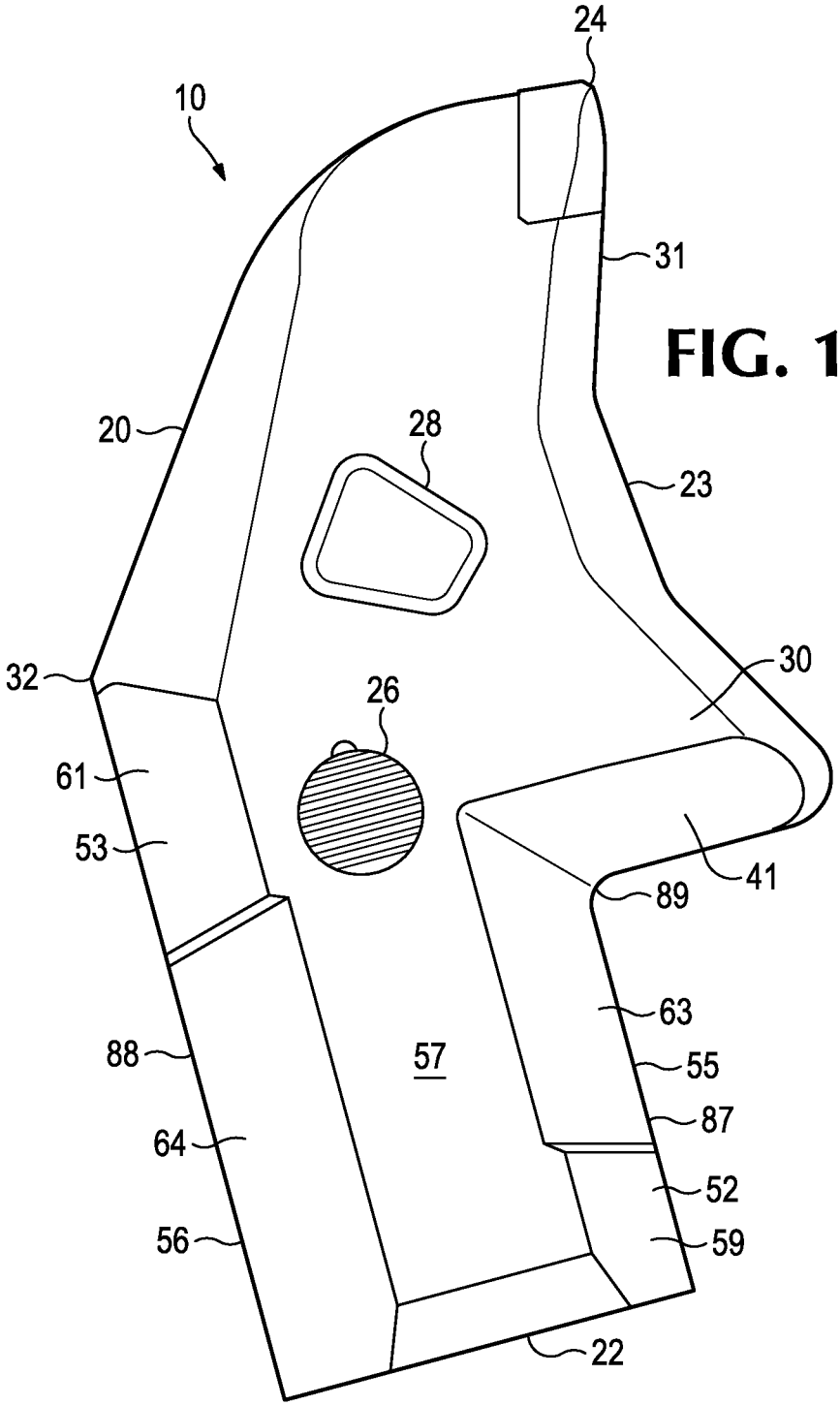
FIG. 13 is a side view of the pick from FIG. 6.
Figure 13A:
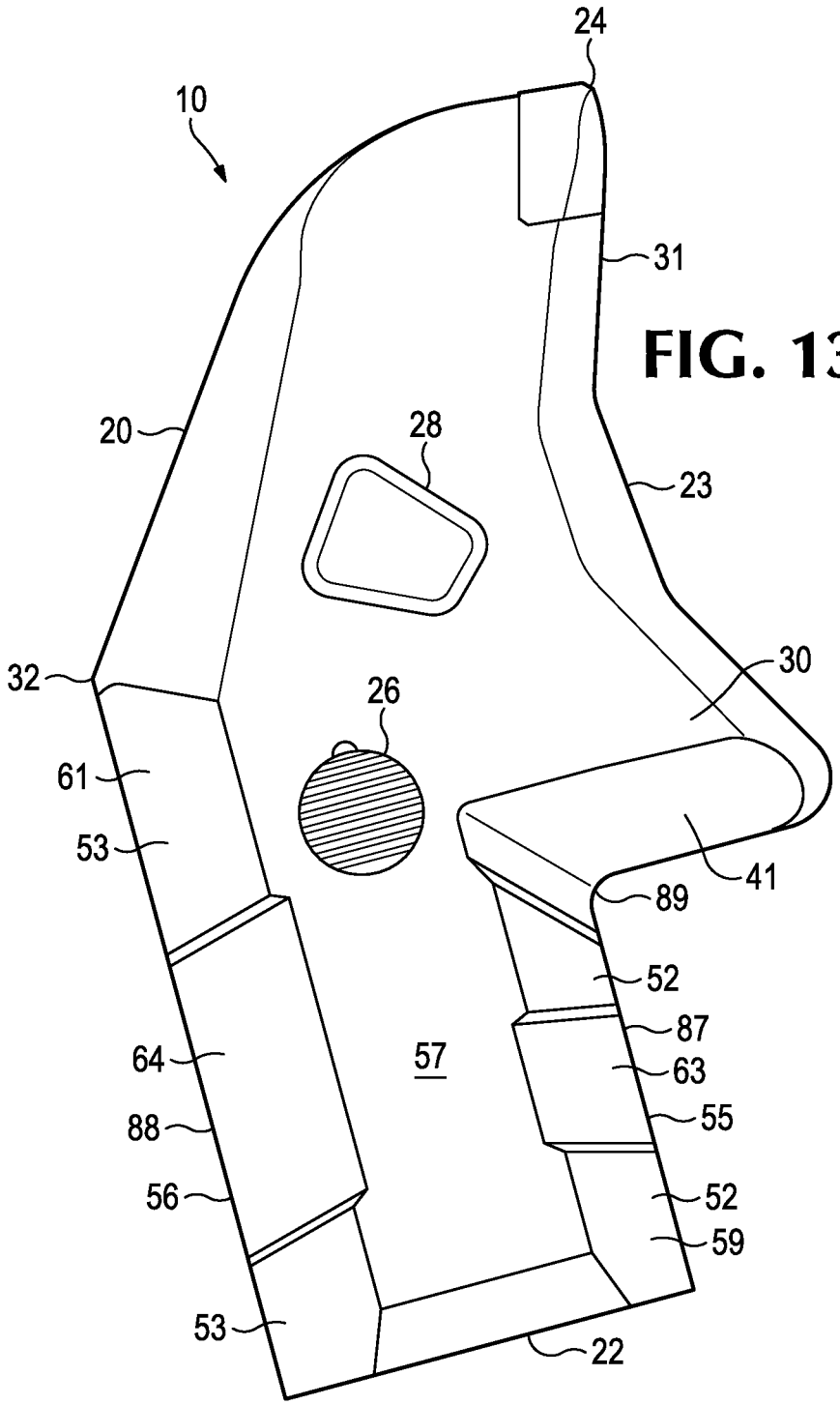
FIG. 13*a* is a side view of an alternative pick assembly of the present invention.

Pick shank 22 preferably has front and rear clearances 63 and 64 on the front and rear corner surfaces 55 and 56. The pick shank 22 may have one or more front and rear clearances 63 and 64. The front and rear clearances create a gap between the pick shank and the pick holder so that the pick and pick holder do not bear against each other where the clearances are located. As shown in FIG. 13*a*, the pick shank may also have a front and rear clearance 63 and 64 that create upper and lower front and rear bearing surfaces 52 and 53 or, as shown in FIGS. 12-16, the pick shank 22 may have front and rear clearances 63 and 64 that create only an upper or a lower front and rear bearing surface 52 and 53. As shown in FIGS. 12-16, front clearances 63 extend from the head 20 downward to the front bearing surfaces 52, the location on pick 10 that will exert reactionary force R1'. Front bearing surfaces 52 are located on front 'V' shaped surfaces 59 and 60. Rear clearances 64 extend from the bottom of the shank 22 upward to the rear bearing surfaces 53, the location on pick 10 that will exert reactionary force R2'. Rear bearing surfaces 53 are located on rear 'V' shaped surfaces 61 and 62. Front and rear clearances 63 and 64 allow shank 22 to only have close tolerance with the opening 14 at the front bearing surfaces 52 and rear bearing surfaces 53 where the reactionary forces R1' and R2' are exerted. Shank 22 having close tolerance with opening 14 in only a minimal number of locations allows shank 22 to be removed with less force. Because manufacturing a product with close tolerances can be costly, the clearances help reduce manufacturing cost by minimizing the areas of close tolerance. Alternatively, the pick shank 22, may not be provided with any front and rear clearances.

Pick 10 mounts in holder 12 with shank 22 fit into opening 14 and shoulder 30 set against the top of the holder (FIG. 7). During use, the pick encounters a wide range of forces F that will at times have a generally inward (e.g., normal) N force component, generally rearward (e.g., tangential) T force component, or a force F having a tangential T force component and a normal N force component. When the forces F tend to have a primarily rearward or tangential T force component, the forces are primarily resisted by rear bearing surfaces 53 of pick 10 bearing against complementary rear bearing surfaces 48 of opening 14, and front bearing surfaces 52 bearing against complementary front bearing surfaces 47 of opening 14; i.e., the loads F with an angle $\alpha$ of approximately 0 degrees are primarily resisted by resultant loads R1', R2'. Similarly, when the forces tend to have a primarily inward or normal N force component (i.e., a force F with an angle $\alpha$ of approximately 90 degrees) the forces are primarily resisted by underside bearing surfaces 41 of shoulder 30 bearing against top bearing surfaces 51 of pick holder 12, rear bearing surfaces 53 of pick 22 bearing against rear bearing surfaces 48 of pick holder 12, and front bearing surfaces 52 bearing against front bearing surfaces 47 of opening 14; i.e., the loads F with an angle $\alpha$ of approximately 90 degrees are primarily resisted by resultant loads R1', R2', and R3'. In this way, front and rear bearing surfaces of the shank and pick holder resist the applied loads if the load F has a predominantly normal N force component, predominantly tangential T force component, or when the F has an angle $\alpha$ between approximately 0 and 90 degrees which minimizes shifting of the pick 10 within pick holder 12. Thus, pick 10 has a natural tendency to abut the front wall 43 and rear wall 44 within the pick holder 12 for the usual expected forces pick 10 will encounter. The reduced shifting minimizes the impact forces of the pick 10 on the pick holder 12.

Moreover, loads F are not consistently applied such that the forces only have a normal N force component and/or a tangential T force component. Rather, the loads will tend to also be applied with a somewhat transverse component as well (see, e.g., load F1 in FIG. 6). The use of front and rear 'V' shaped bearing surfaces 52, 53 on shank 22 and front and rear 'V' shaped surfaces 47, 48 in opening 14 along with 'V' shaped underside bearing surfaces 41 of shoulder 30 and 'V' shaped top bearing surfaces 51 of pick holder 12 are able resist side loads (i.e., loads such as F1 that have a transverse component). In this way, the same bearing surfaces are able to resist the forces F that have a generally normal N force component, generally tangential T force component, and side components of the expected loads on the pick. Using the same bearing surfaces to resist normal force components, tangential force components, and side loading reduces the shifting that ordinarily occurs between the pick and the pick holder, which results in less wear of both components and a longer useful life. This is particularly beneficial for the pick holder because of the difficulty and time required to replace a pick holder as compared to a pick.

In an alternative embodiment (FIGS. 5 and 17-25), pick assembly 108 includes a pick holder 112 that is similar in many ways to pick holder 12 with many of the same benefits and purposes. The following discussion focuses on the differences and does not repeat all the similarities that apply to pick assembly 108. In this embodiment, pick assembly 108 includes a securement mechanism 126 in the form of a pin. Securement mechanism 126 is inserted into a hole 190 in one side of pick holder 112 and extends through pick 110 to the other side of the pick holder. The hole 190 may extend all the way through the pick holder, as shown, or the hole may only extend completely through a portion of the pick holder. In addition, a locking mechanism such as a cotter pin, a bolt with or without a nut, a cover plate, or a retaining ring may be used to keep pin 126 in hole 190. Alternatively, the securement mechanism 126 could be a lock other than a pin that is known in the art.

Figure 21:
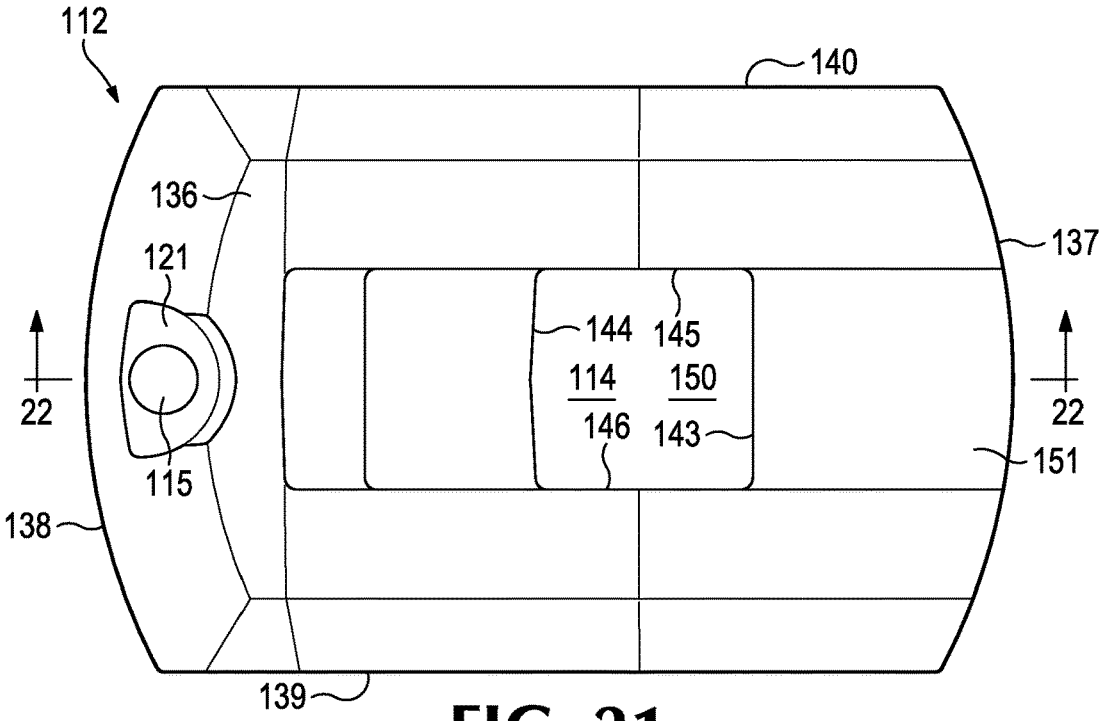
FIG. 21 is a top view of the pick holder from FIG. 17.
Figure 22:
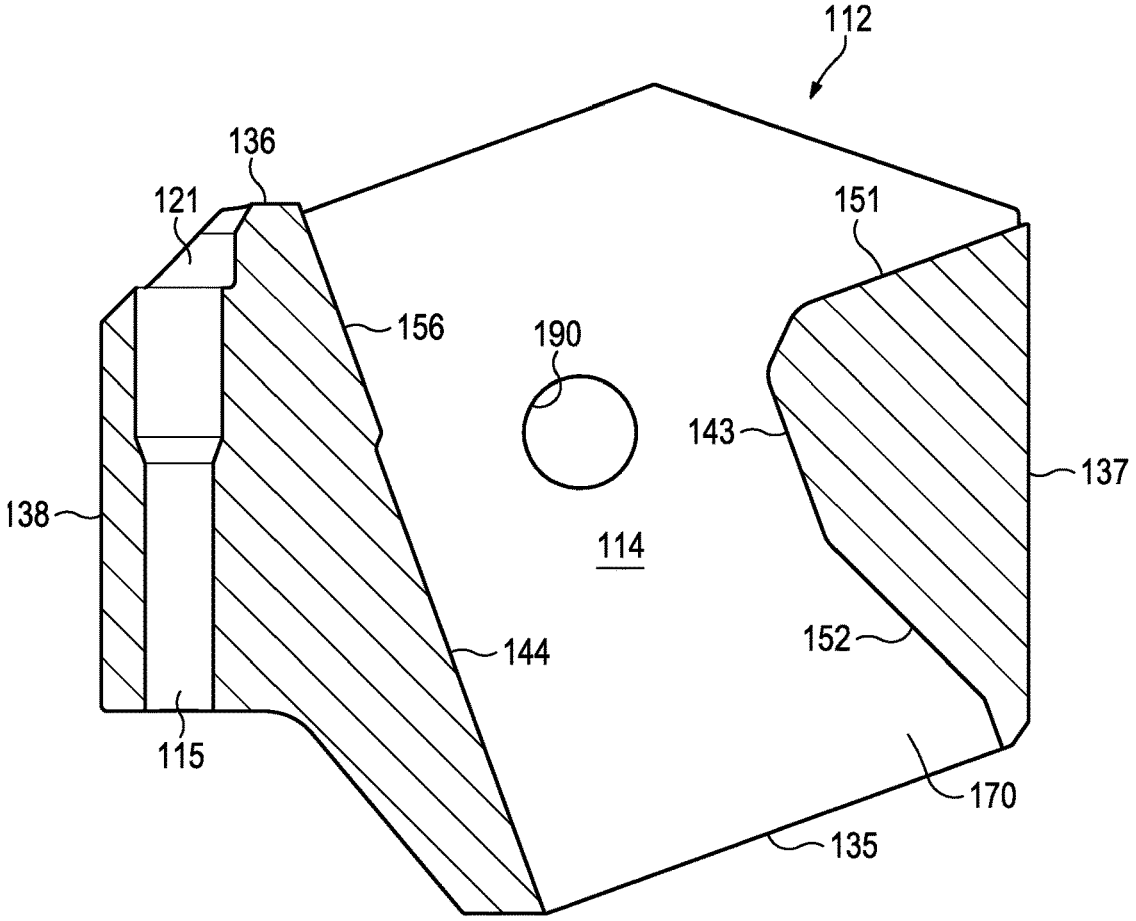
FIG. 22 is a cross section of the pick holder taken along line 22-22 in FIG. 21.
Figure 24:
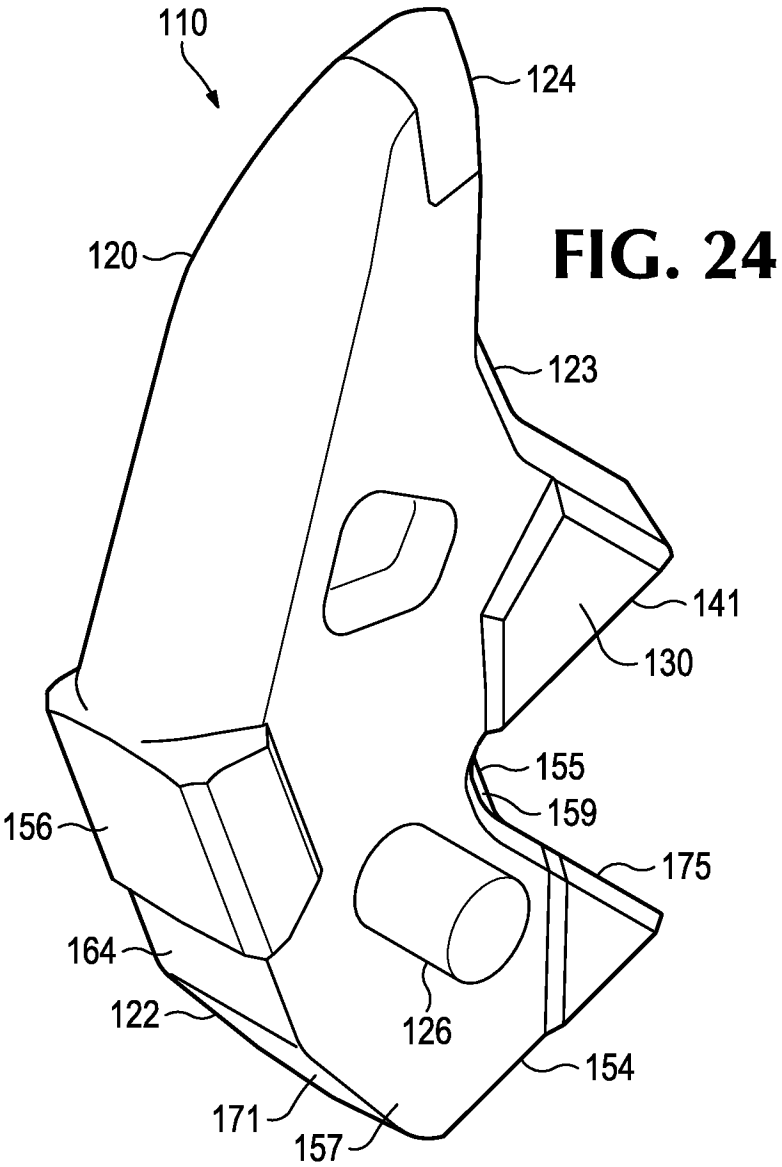
FIG. 24 is a rear perspective view the pick from FIG. 17.
Figure 23:
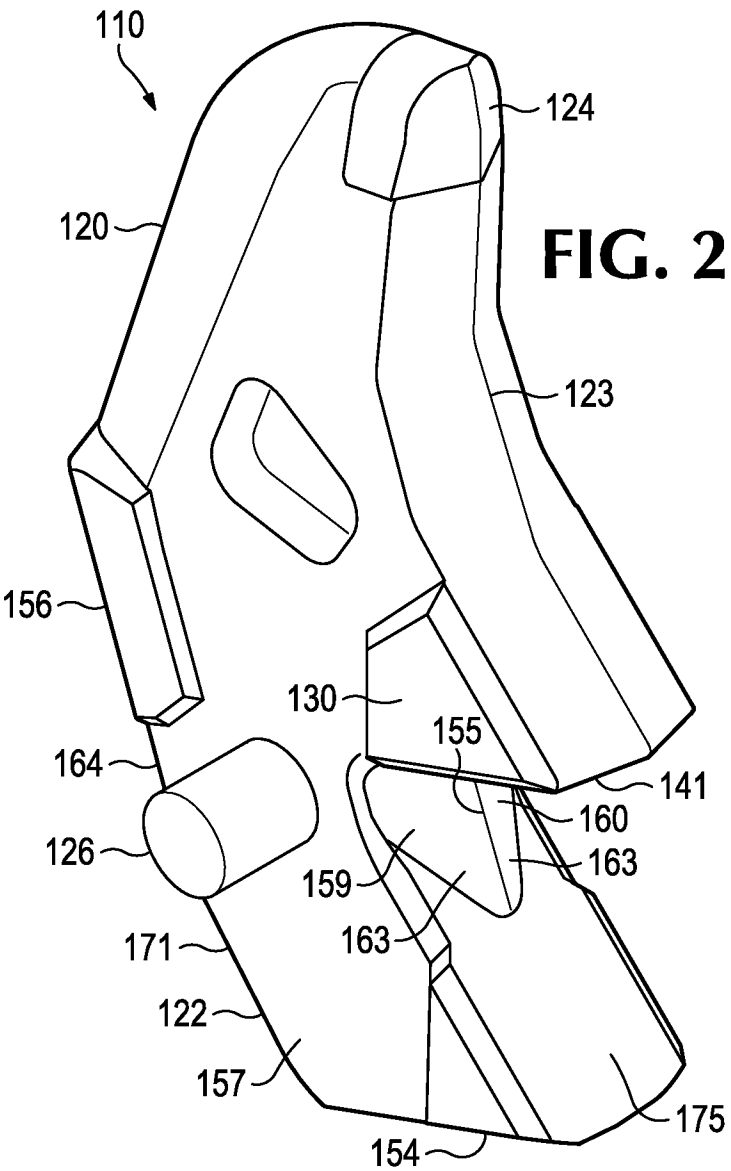
FIG. 23 is a front perspective view the pick from FIG. 17.
Figure 25:
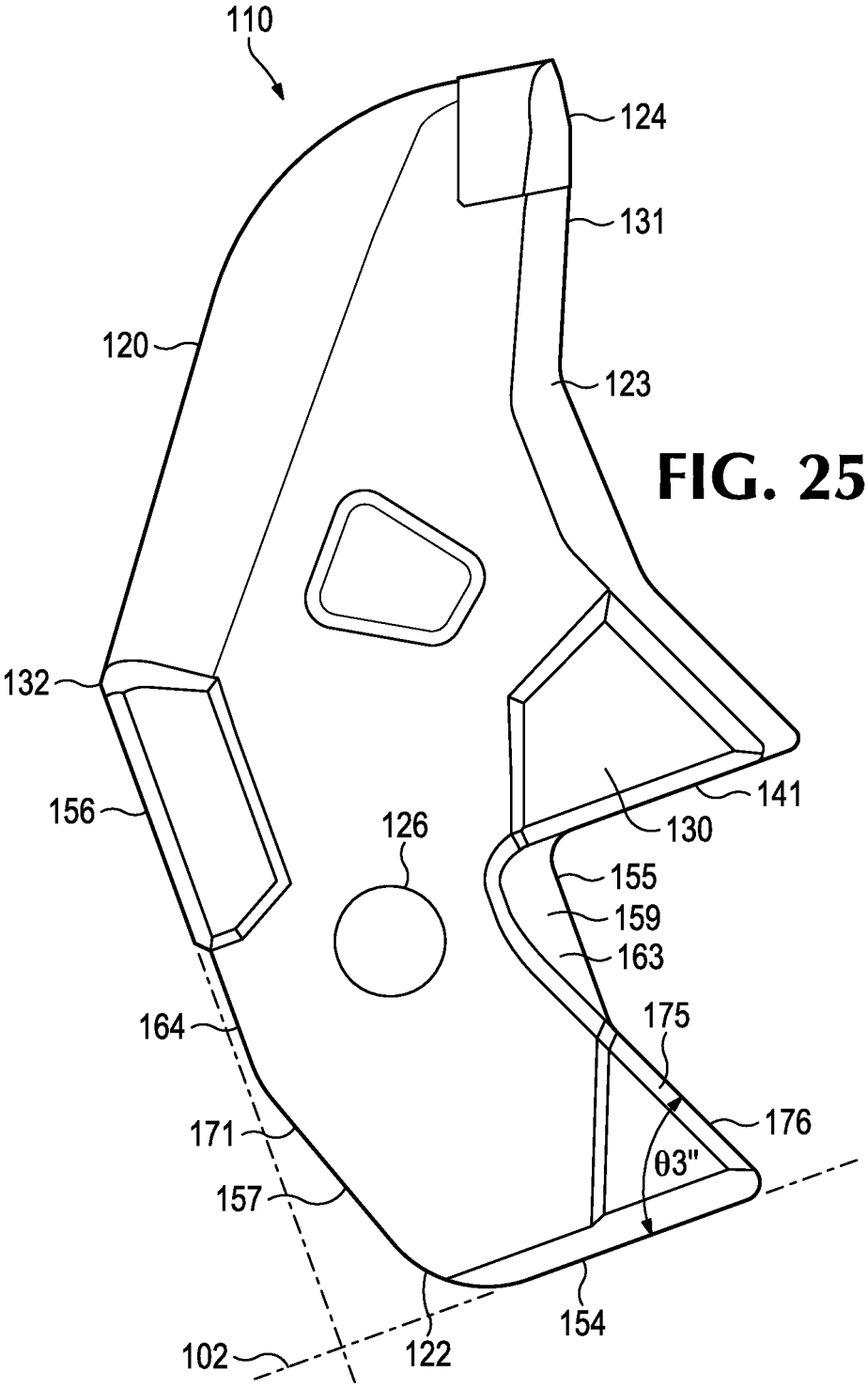
FIG. 25 is a side view of the pick from FIG. 17.

Pick holder 112 includes a bottom surface 135, a top surface 136, a leading face 137, a trailing face 138, and side surfaces 139 and 140. Opening 114 extends from the bottom surface 135 to the top surface 136 and preferably through a central region of pick holder 112. Opening 114 comprises front and rear surfaces 143 and 144, and side surfaces 145 and 146. As can be seen in FIG. 21, opening 114 includes a shank-receiving portion 150 having a generally rectangular shape. Other shapes could be used such as the generally diamond shape of opening 14 in pick holder 12 of pick assembly 8. Likewise, pick holder 12 could have an opening with a rectangular shaped shank receiving portion.

Pick holder 112 includes a recess 170 within opening 114 extending from the bottom surface 135 towards the leading face 137. Recess 170 has a rearwardly inclined front bearing surface 152 to receive and bear against a complementary securing structure 175 on pick 110. In one preferred embodiment the securing structure is a C-shaped hook 175, but the securing structure may have other shapes. The use of a hook 175 engaging shank-receiving portion 150 reduces the likelihood of the pick being ejected from the pick holder even when the pick shank 122 is rearwardly inclined. Less risk of ejection can also enable the use of a greater rearward inclination of the shank (i.e., the bearing surfaces of the shank) to better resist the expected applied loads in certain uses. In some cases, the use of hook 175 engaging shank-receiving portion 150 better distributes reaction forces so that R1" and R2" share some of the greater loading normally experienced at R2" thus reducing the contact pressure at R2". Accordingly, opening 114 is preferably rearwardly inclined to normal line 101. In the example of the drum, line 101 extends normally through the strike point of the tip 24 to the center of rotation of the pick assembly 108 around the drum 6. Opening 114 is preferably rearwardly inclined relative to normal line 101 at an angle θ2" of about 11-35 degrees, though larger and smaller angles could be used. In one preferred example, angle θ2" is about 20 degrees. Similarly, opening 114 is preferably forwardly declined from top surface 136 of pick holder 112 with an angle θ1" of about 55-80 degrees. In one preferred embodiment opening 114 is forwardly declined from top surface 136 with an angle θ1" of about 70 degrees.

Top bearing surface 151 is preferably inclined forward relative to the direction of a force F having an inward or normal N force component such that top bearing surface 151 extends generally perpendicular to rear surfaces 144. This inclination provides resistance to expected normal loads without undue stress in the components during use. Other shapes and angles of inclination could be used such as the generally V shaped top bearing surfaces of pick 10. Top bearing surface 151 abuts against corresponding underside bearing surface 141 of pick 110. In a preferred embodiment, front bearing surface 152 of pick holder 112 is lined with hard-facing material where the pick shank 122 exerts the reactionary force R1" on the pick holder. The pick holder may also be lined with hard-facing where the pick exerts reactionary forces R2" and R3" on the pick holder, where the pick holder experiences wash, where the pick lock is maintained in the pick holder, and other locations on the pick holder that experience heavy wear.

Pick holder 112, like pick holder 12, also preferably has a duct or bore 115 extending from the bottom surface 135 of trailing face 138 to the top surface 136 of trailing face 138 of holder 112. In some instances, bore 115 may be a blind bore extending from top surface 136 that adjoins a blind bore extending from the trailing face 138 or one of the side surfaces 139 or 140 (not shown). Bore 115 may be located in the shadow of pick 110, but could be located elsewhere. Bore 115 has a counterbore 121 at the top surface 136 of holder 112 for receiving a low profile water sprayer (not shown) for spraying tip 124 of the pick 110 and the coal with water.

Pick 110, includes a shank 122 to maintain pick 110 in pick holder 112, and a head 120 to impact the material to be excavated. Shank 122 is maintained within opening 114 in pick holder 112 with a latching arrangement 126. To minimize undesired movement of the pick 110 within the pick holder 112, shank 122 remains positively engaged with the pick holder 112 on front and rear bearing surfaces regardless of whether the loads F have a predominantly inward N force component or a predominantly rearward T force component. In this embodiment, shank 122 is preferably rearwardly inclined from a force F with a purely normal N force component. The shank 122 is preferably rearwardly inclined relative to line 101 with an angle θ2" of about 11-35 degrees, though larger and smaller angles are possible. In one preferred embodiment, shank 122 is rearwardly inclined relative to line 101 with an angle θ2" of about 20 degrees. The rearward inclination of the shank 122 adds stability by giving the pick 110 a natural tendency to abut the front bearing surface 152 and rear bearing surface 156 within the pick holder 112 for the usual expected forces pick 110 will encounter.

Shank 122 is supported in opening 114 of pick holder 112 and has the same general shape as opening 114. Shank 122, comprises a front corner surface 155, rear and side surfaces 156-158, a C-Shaped hook 175, and a clearance or chamfer surface 171. Side surfaces 157-158 are generally planer and extend down from head 120 of pick 110. The front corner surface 155 of shank 122 extends down from head 120 of pick 110 and creates V shaped front surfaces 159 and 160 that meet at front corner surface 155. A C-shaped hook 175 extends forward and below the V shaped front surfaces 159 and 160 towards the bottom surface 154 of shank 122. The C-Shaped hook 175 has a generally planer surface 176 that is preferably rearwardly inclined from a line 102 with an angle θ3" of about 0 to 90 degrees. Line 102 extends perpendicular to rear surface 156 and preferably along bottom surface 154, but the bottom surface could have other orientations. In one preferred embodiment the generally planer surface 176 of C-Shaped hook 175 is preferably rearwardly inclined from line 102 with an angle θ3" of about 45 to 55 degrees. The C-shaped hook better resists ejection of the pick during use. It can also allow a greater rearward inclination. Chamfer surface 171 is generally planer and extends from bottom surface 154 to rear surface 156. Rear surface 156 is generally planer and extends downward from head 120 of pick 110. Although planer bearing surfaces are preferred, they could have other shapes. The chamfer surface 171 enables the shank 122 with the C-shaped hook 175 to easily be inserted in opening 114. Other shank shapes could be used such as the generally diamond shape shank in pick 10 along with the C-shaped hook described above.

Head 120 of pick 110 comprises a shoulder 130 and blade 123. Blade 123 has a tip 124 at the top leading face 131 to impact the ground to be excavated. Shoulder 130 along with shank 122 stabilizes the pick 110 within the pick holder 112. Shoulder 130 has an underside bearing surface 141. Underside bearing surface 141 is preferably forwardly inclined to normal line 101. Underside bearing surface 141 is preferably oriented relative to rear bearing surface 156 with an angle within a range of 90 to 115 degrees (when measured from the rear bearing surface 156 counter-clockwise to the underside bearing surface) to better resist movement of the pick within the pick holder. In one preferred embodiment, underside bearing surface 141 is inclined 105 degrees to rear surface 156 to control the fracture force outlined below.

Underside bearing surface is preferably planer and shaped to be received in complementary top bearing surfaces 151 within the pick holder 112. Other shapes could be used such as the generally V shaped underside bearing surfaces of pick 10. Head 120 is preferably free of a heel enabling the front bearing surface 152 and rear bearing surface 156 of the opening 114 in the pick holder 112 to more fully bear the reactionary forces experienced when a force F has a generally tangential T force component or a generally normal N force component.

Pick 110, like pick 10, is preferably designed to break where the head 120 meets the shank 122 when subjected to fracture forces. This allows shank 122 to be easily removed by pushing shank 122 through the bottom of opening 114 within the pick holder 112 and removing the shank 122 through notch 107 in the drum 6. As with pick 10, the juncture of V shaped front surfaces 159, 160 and underside bearing surface 141 is designed to create a natural point of high stress so that the shoulder breaks from the shank.

Shank 122, like shank 22, preferably has front and rear clearances 163 and 164 on the front and rear surfaces 155 and 156. Front clearances 163 extend from the head 120 downward to the front bearing surface 152, the location on pick 110 that will exert reactionary force R1". Front bearing surface 152 is located on the top of C-shaped hook 175. Rear clearance 164 extends from the top of chamfer surface 171 upward to the rear bearing surface 156, the location on pick 110 that will exert reactionary force R2". The rear bearing surface is located on rear surface 156. Front and rear clearances 163 and 164 and chamfer surface 171 allow shank 122 to only have close tolerance with the opening 114.

The above disclosure describes specific examples of assemblies that include different aspects or features of the invention. The various inventive features are preferably used together in ways as described in the two embodiments. Nevertheless, the various features can be used alone and still gain certain benefits of the invention. For example, picks having a rearwardly inclined shank can be used and the benefits gained regardless of whether they are combined with other inventive features such as laterally inclined bearing surfaces, hook structures, hard-facing, and the like. This could be the case for each of the inventive features disclosed. Also, features in one embodiment can be used with features of the other embodiment. The examples given and the combination of features disclosed are not intended to be limiting in the sense that they must be used together.

The invention claimed is:

1. A pick for attachment to an excavating machine comprising a head having a strike point to strike a surface to be excavated when moved forward during operation, and a shank extending from the head to be received into a pick holder secured to the excavating machine, the shank being oriented such that a line aligned with a true inwardly-directed force extending normal to the forward movement and applied to the strike point will intersect the shank, wherein the shank has a front end and a rear end opposite the front end, and sidewalls extending between the front and rear ends, and wherein the front end and the rear end each includes a pair of planar bearing surfaces to bear against complementary surfaces on the pick holder, and the bearing surfaces in each said pair converge toward each other as they extend from the sidewalls.

2. The pick in accordance with claim 1 including a shoulder having a bearing surface to bear against the pick holder, wherein the bearing surface of the shoulder extends forward of the line.

3. A pick in accordance with claim 2 including a front corner surface at a juncture of the head and the shank, and wherein the front corner surface causes the head to be broken from the shank when subjected to fracture forces.

4. A pick in accordance with claim 2 wherein the shoulder is provided with diverging surfaces to bear against the pick holder.

5. A pick in accordance with claim 4 wherein the diverging surfaces are 'V' shaped.

6. A pick in accordance with claim 1 wherein each said pair of bearing surfaces are 'V' shaped.

7. A pick in accordance with claim 1 wherein the shank includes a C-shaped hook to bear against a complementary recess in the pick holder.

8. A pick in accordance with claim 1 wherein the head includes a blade and a shoulder below the blade, the shoulder extends farther forward than the blade to resist inwardly directed forces by bearing against the pick holder.

9. A pick in accordance with claim 8 wherein the shoulder has an underside bearing surface that is forwardly inclined relative to a rear bearing surface.

10. A pick in accordance with claim 8 wherein an underside bearing surface is forwardly inclined relative to a rear bearing surface at an angle within a range of about 75 to 115 degrees.

11. A pick in accordance with claim 10 wherein the underside bearing surface is forwardly inclined about 105 degrees.

12. A pick for attachment to an excavating machine comprising a head having a strike point to strike a surface to be excavated when moved forward during operation, and a shank extending from the head to be received into a pick holder secured to the excavating machine, the shank being oriented such that a line aligned with a true inwardly-directed force extending normal to the forward movement and applied to the strike point will intersect the shank, including a shoulder having at least one bearing surface to bear against the pick holder that extends farther forward than the line, wherein the shank has a front end and a rear end opposite the front end, and sidewalls extending between the front and rear ends, and wherein the front end and the rear end each includes a pair of planar bearing surfaces to bear against complementary surfaces on the pick holder, and the bearing surfaces in each said pair converge toward each other as they extend from the sidewalls.

13. A pick in accordance with claim 12 wherein the shank has front and rear bearing surfaces to bear against the pick holder, and wherein each of the front and rear bearing surfaces on the shank remain engaged against the pick holder when during use forces applied to a distal end of the head transition between inward and rearward.

14. A pick in accordance with claim 12 wherein the shank includes a C-shaped hook to bear against a complementary recess in the pick holder.

15. A pick in accordance with claim 12 wherein the shank has a front end and a rear end, and wherein the front end and the rear end each has (i) a bearing surface to bear against the pick holder and (ii) at least one non-bearing surface recessed relative to the respective bearing surface to provide clearance with the pick holder.

16. A pick in accordance with claim 12 wherein the pick is a cast part.

17. A pick in accordance with claim 12 wherein the pick is a forged part.

18. A pick in accordance with claim 12 wherein the shank has a non-circular cross-sectional shape.

19. A pick in accordance with claim 12 wherein the shank is rearwardly inclined to the line as the shank extends toward the head.

20. A pick in accordance with claim 19 wherein the shank is rearwardly inclined to the line at an angle of about 11-35 degrees.

21. A pick in accordance with claim 19 wherein the shank is rearwardly inclined to the line at an angle of about 15-20 degrees.

22. A pick in accordance with claim 19 wherein the shank is rearwardly inclined to the line at an angle of about 15 degrees.

23. A pick in accordance with claim 19 wherein the shank is rearwardly inclined to the line at an angle of about 20 degrees.

24. A pick in accordance with claim 12 wherein the pick is free of a heel to the rear of the shank.

25. A pick in accordance with claim 12 wherein a recess is provided in a side of the head to be engaged by a tool to aid in installing and removing the pick in and from the pick holder.

26. A pick in accordance with claim 12 wherein the head includes a carbide tip that defines the strike point.

27. A pick for attachment to an excavating machine comprising a shank to be received into a pick holder secured to the excavating machine, a blade having a strike point to strike a surface to be excavated when moved forward during operation and a forwardly extending shoulder with an underside bearing surface to bear against the pick holder, wherein the underside bearing surface extends forward of a line aligned with a true inwardly-directed force extending normal to the forward movement and applied to the strike point and the pick is free of a heel to the rear of the shank.

28. A pick in accordance with claim 27 wherein the bearing surface of the shoulder includes diverging surfaces to bear against the pick holder.

29. A pick in accordance with claim 28 wherein the shank has a width and the diverging surfaces have a width that is less than or equal to the width of the shank, wherein both said widths are transverse to the forward movement of the pick.

30. A pick in accordance with claim 28 wherein the diverging surfaces are 'V' shaped.

31. A pick in accordance with claim 27 wherein the shank includes a rear bearing surface and a front hook, the front hook has a planer surface to bear against a complementary recess in the pick holder, and the planer surface is rearwardly inclined to a plane perpendicular to the rear bearing surface.

32. A pick in accordance with claim 31 wherein the planer surface is rearwardly inclined to the plane perpendicular to the rear bearing surface at an angle within a range of about 45 to 55 degrees.

33. A pick in accordance with claim 27 wherein the shank includes a front side and a rear side, and each of the front and rear sides includes at least one bearing surface to bear against the pick holder and at least one recessed surface to provide clearance between the shank and the pick holder.

34. A pick in accordance with claim 27 wherein the pick is a cast part.

35. A pick in accordance with claim 27 wherein the pick is a forged part.

36. A pick in accordance with claim 27 wherein the shank has a non-circular cross-sectional shape.

37. A pick in accordance with claim 27 wherein the shank is rearwardly inclined to the line as the shank extends toward the blade.

38. A pick in accordance with claim 37 wherein the rearward inclination of the shank to the line is at an angle of about 11-35 degrees.

39. A pick in accordance with claim 37 wherein the rearward inclination of the shank to the line is at an angle of about 15-20 degrees.

40. A pick in accordance with claim 37 wherein the rearward inclination of the shank to the line is at an angle of about 15 degrees.

41. A pick in accordance with claim 37 wherein rearward inclination of the shank to the line is at an angle of about 20 degrees.

42. A pick in accordance with claim 27 wherein the blade includes at least one recess on at least one side to be engaged with a tool to aid in installing and removing the tool.

43. A pick in accordance with claim 27 wherein the blade includes a carbide tip that defines the strike point.

44. A pick assembly for attachment to an excavating machine for working a material to be excavated, the pick assembly comprising:

a pick holder adapted to be secured to the excavating machine, the pick holder having an opening and a bearing surface;

a pick comprising a blade having a strike point to strike a surface to be excavated when moved forward during operation, a shank extending from the blade to be received into the opening in the pick holder, and a forwardly-extending shoulder with an underside bearing surface to bear against the bearing surface of the pick holder, wherein the pick is free of a heel to the rear of the shank and the underside bearing surface of the shoulder extends forward of a line aligned with a true inwardly-directed force extending normal to the forward movement and applied to the strike point; and a securement mechanism to secure the pick to the pick holder.

45. A pick for attachment to an excavating machine comprising a head having a strike point that moves forward during use to impact and separate material to be excavated, and a shank extending from the head to be received in a pick holder secured to the excavating machine, wherein the head has a shoulder with a bearing surface that extends forward from the shank to bear against the pick holder, and is free of a heel with an underside bearing surface extending rearward from a longitudinal extension of the exterior of the shank.

46. A pick in accordance with claim 45 wherein the shank includes a C-shaped hook to bear against a complementary recess in the pick holder.

47. A pick in accordance with claim 45 wherein the bearing surface of the shoulder extends farther forward than a line aligned with a true inwardly-directed force extending normal to the forward movement and applied to the strike point of the head.

48. A pick in accordance with claim 47 wherein the head includes a carbide tip that defines the strike point.

* * * * *